US007255070B2

(12) United States Patent
Hofbauer

(10) Patent No.: US 7,255,070 B2
(45) Date of Patent: Aug. 14, 2007

(54) INTERNAL COMBUSTION ENGINE

(75) Inventor: Peter Hofbauer, West Bloomfield, MI (US)

(73) Assignee: Advanced Propulsion Technologies, Inc., Goleta, CA (US)

( * ) Notice: Subject to any disclaimer, the term of this patent is extended or adjusted under 35 U.S.C. 154(b) by 0 days.

(21) Appl. No.: 11/437,115

(22) Filed: May 18, 2006

(65) Prior Publication Data

US 2006/0201456 A1 Sep. 14, 2006

Related U.S. Application Data

(60) Division of application No. 10/941,173, filed on Sep. 14, 2004, which is a continuation of application No. PCT/US03/08707, filed on Mar. 17, 2003, and a continuation of application No. PCT/US03/08708, filed on Mar. 17, 2003, and a continuation of application No. PCT/US03/08709, filed on Mar. 17, 2003.

(60) Provisional application No. 60/364,662, filed on Mar. 15, 2002.

(51) Int. Cl.
*F02B 71/04* (2006.01)
*F02B 75/04* (2006.01)

(52) U.S. Cl. ..... 123/46 R; 417/364

(58) Field of Classification Search ..... 123/46 R, 123/46 A, 46 B; 417/341, 364
See application file for complete search history.

(56) References Cited

U.S. PATENT DOCUMENTS

| | | | |
|---|---|---|---|
| 1,167,366 | A | 1/1916 | Fessenden |
| 1,232,174 | A | 7/1917 | Bachelet |
| 1,616,137 | A | 2/1927 | Palmer |
| 1,639,334 | A | 8/1927 | Ford |
| 1,719,537 | A | 7/1929 | Dulche |
| 1,875,838 | A | 9/1932 | Winckler |
| 2,041,708 | A | 5/1936 | Harper, Jr. |
| 2,254,817 | A | 9/1941 | Blenker |
| 2,693,076 | A | 11/1954 | Francis |
| 2,904,701 | A | 9/1959 | Colgate |

(Continued)

FOREIGN PATENT DOCUMENTS

| | | |
|---|---|---|
| DE | 4243255 | 6/1994 |

(Continued)

OTHER PUBLICATIONS

PCT International Search Report dated Jun. 16, 2003 for PCT application No. PCT/US03/08708, filed Mar. 17, 2003, 3 pages.

(Continued)

*Primary Examiner*—Stephen K. Cronin
*Assistant Examiner*—Hyder Ali
(74) *Attorney, Agent, or Firm*—Ganz Law, P.C.

(57) ABSTRACT

Embodiments in accordance with the present invention provide an opposed piston, opposed cylinder (OPOC) internal combustion engine. The OPOC engine comprises two cylinders opposed at 180 degrees. A linking element connects two outer pistons so that they move in tandem. A central piston is disposed between and moves in opposition to the outer pistons. The linking element is adapted to drive secondary mechanisms in accordance with embodiments of a drive shaft, electric generator, hydraulic pump, pneumatic pump, and gear-driven mechanisms, among others.

11 Claims, 27 Drawing Sheets

U.S. PATENT DOCUMENTS

| | | | | |
|---|---|---|---|---|
| 3,105,153 | A | | 9/1963 | James |
| 3,106,896 | A | | 10/1963 | Van Der Lely et al. |
| 3,200,800 | A | | 8/1965 | Du Bois |
| 3,347,215 | A | | 10/1967 | Pescara |
| 3,485,221 | A | | 12/1969 | Feeback |
| 3,501,087 | A | | 3/1970 | Benaroya |
| 3,541,362 | A | | 11/1970 | Pouit |
| 3,669,571 | A | | 6/1972 | Benaroya |
| 3,895,620 | A | | 7/1975 | Foster |
| 4,046,115 | A | * | 9/1977 | Braun ..... 123/46 R |
| 4,087,205 | A | | 5/1978 | Heintz |
| RE30,176 | E | | 12/1979 | Beale |
| 4,205,528 | A | | 6/1980 | Grow |
| 4,248,183 | A | | 2/1981 | Noguchi et al. |
| 4,254,745 | A | | 3/1981 | Noguchi et al. |
| 4,257,365 | A | | 3/1981 | Noguchi et al. |
| 4,258,669 | A | | 3/1981 | Noguchi et al. |
| 4,270,054 | A | | 5/1981 | Dowd |
| 4,305,349 | A | | 12/1981 | Zimmerly |
| 4,369,021 | A | | 1/1983 | Heintz |
| 4,415,313 | A | | 11/1983 | Bouthors |
| 4,429,668 | A | | 2/1984 | Nakagawa et al. |
| 4,480,597 | A | | 11/1984 | Noguchi et al. |
| 4,480,599 | A | | 11/1984 | Allias |
| 4,485,768 | A | | 12/1984 | Heniges |
| 4,491,096 | A | | 1/1985 | Noguchi et al. |
| 4,532,431 | A | | 7/1985 | Iliev et al. |
| 4,565,165 | A | | 1/1986 | Papanicolaou |
| 4,627,389 | A | | 12/1986 | Simon |
| 4,649,283 | A | | 3/1987 | Berchowitz et al. |
| 4,661,050 | A | | 4/1987 | Deminski |
| 4,694,785 | A | | 9/1987 | Timmerman et al. |
| 4,697,113 | A | | 9/1987 | Young |
| 4,720,640 | A | | 1/1988 | Anderson et al. |
| 4,776,166 | A | | 10/1988 | Dixon |
| 4,815,294 | A | | 3/1989 | David |
| 4,864,976 | A | | 9/1989 | Falerno |
| 4,873,826 | A | | 10/1989 | Dhar |
| 4,924,956 | A | | 5/1990 | Deng et al. |
| 4,974,556 | A | | 12/1990 | Royse |
| 4,975,026 | A | | 12/1990 | Pruszenski |
| 4,977,864 | A | | 12/1990 | Grant |
| 5,115,725 | A | | 5/1992 | Horiuchi |
| 5,163,388 | A | | 11/1992 | Jonsson |
| 5,280,213 | A | | 1/1994 | Day |
| 5,397,922 | A | | 3/1995 | Paul et al. |
| 5,406,911 | A | | 4/1995 | Hefley |
| 5,413,074 | A | | 5/1995 | Horiuchi |
| 5,421,293 | A | | 6/1995 | Noltemeyer et al. |
| 5,427,067 | A | | 6/1995 | Horiuchi |
| 5,476,074 | A | | 12/1995 | Boggs et al. |
| 5,479,894 | A | | 1/1996 | Noltemeyer et al. |
| 5,559,379 | A | | 9/1996 | Voss |
| 5,560,327 | A | | 10/1996 | Brackett |
| 5,586,540 | A | | 12/1996 | Marzec et al. |
| 5,654,596 | A | | 8/1997 | Nasar |
| 5,693,991 | A | | 12/1997 | Hiterer |
| 5,775,273 | A | | 7/1998 | Beale |
| 5,794,582 | A | | 8/1998 | Horiuchi |
| 5,850,111 | A | | 12/1998 | Haaland |
| 5,884,590 | A | | 3/1999 | Minculescu |
| 5,893,343 | A | | 4/1999 | Rigazzi |
| 6,141,971 | A | | 11/2000 | Hanes |
| 6,147,415 | A | | 11/2000 | Fukada |
| 6,170,443 | B1 | | 1/2001 | Hofbauer |
| 6,199,519 | B1 | | 3/2001 | Van Blarigan |
| 6,513,464 | B1 | | 2/2003 | Busch |
| 6,513,465 | B2 | | 2/2003 | Fukuoka et al. |
| 6,513,466 | B2 | | 2/2003 | Bignion |
| 6,541,875 | B1 | | 4/2003 | Berlinger et al. |
| 2006/0124084 | A1 | | 6/2006 | Hofbauer et al. |
| 2006/0138777 | A1 | | 6/2006 | Hofbauer et al. |

FOREIGN PATENT DOCUMENTS

| | | |
|---|---|---|
| DE | 19503443 | 5/1995 |
| DE | 19503444 | 5/1996 |
| DE | 19503413 | 8/1996 |
| DE | 19943993 | 3/2001 |
| FR | 852918 | 3/1940 |
| GB | 531009 | 12/1940 |
| JP | 46-13884 | 4/1971 |
| JP | 48-25562 | 7/1973 |
| JP | SHO 55-76827 | 5/1980 |
| JP | SHO 58-10115 | 1/1983 |
| JP | HEI 7-102990 | 4/1995 |
| JP | 2000-104560 | 4/2000 |
| WO | WO9415073 | 7/1994 |
| WO | WO 02/48524 | 6/2002 |
| WO | WO 03/078809 | 9/2003 |
| WO | WO 03/078810 | 9/2003 |
| WO | WO 03/078835 | 9/2003 |
| WO | WO2005003532 | 1/2005 |
| WO | WO2005060381 C2 | 7/2005 |

OTHER PUBLICATIONS

PCT International Search Report dated Aug. 14, 2001 for PCT application No. PCT/US00/34122, filed Dec. 15, 2000, 3 pages.

PCT International Search Report and Written Opinion dated Oct. 19, 2004 for PCT application NO. PCT/US04/20590, filed Jun. 25, 2004, 6 pages.

PCT International Search Report dated Sep. 8, 2003 for PCT application No. PCT/US03/08707, filed Mar. 17, 2003, 3 pages.

PCT International Search Report dated Aug. 1, 2003 for PCT application No. PCT/US03/08709, filed Mar. 17, 2003, 4 pages.

PCT International Search Report and Written Opinion dated Nov. 30, 2005 for PCT application No. PCT/US04/20598, filed Jun. 24, 2004, 6 pages.

Office action dated Mar. 6, 2007 of the Japanese Patent Office, Examiner Hiroki Inaba, for corresponding JP Serial No. 2003-576788 (3 pages).

* cited by examiner

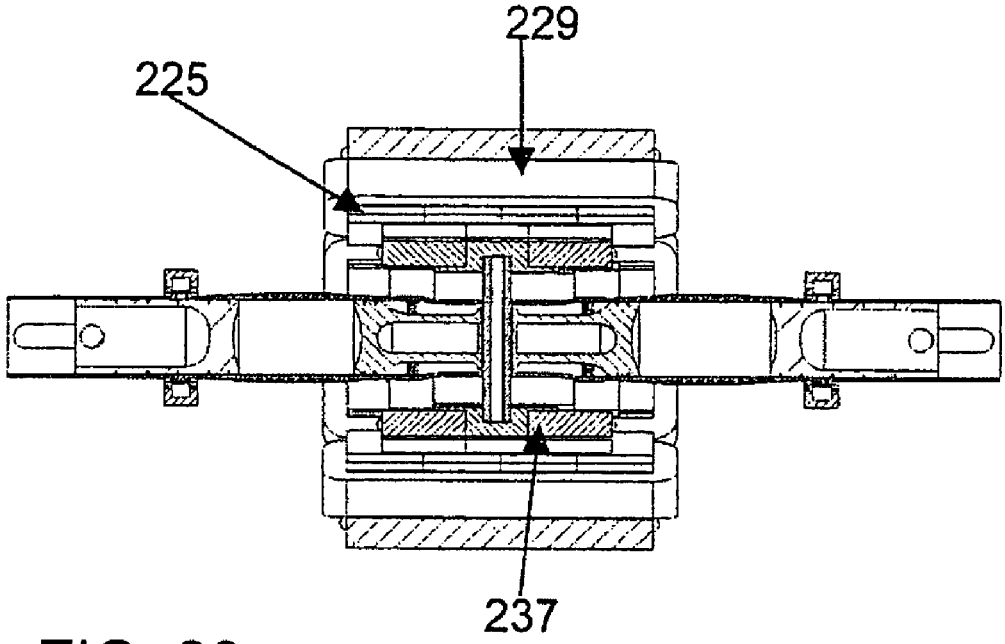
FIG. 23a
FIG. 23c
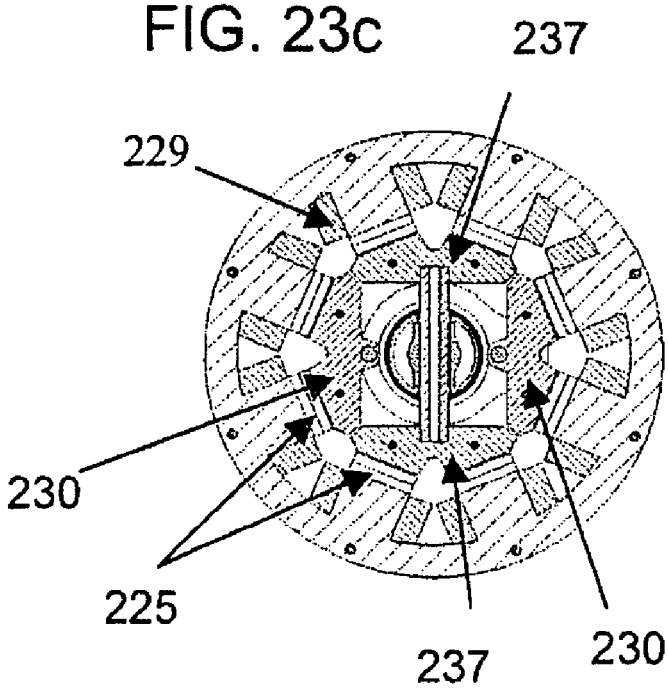

INTERNAL COMBUSTION ENGINE

BACKGROUND OF THE INVENTION

This application is a Divisional of U.S. patent application Ser. No. 10/941,173, filed Sep. 14, 2004, which is a Continuation of PCT Patent Application Nos. PCT/US03/08708, filed Mar. 17, 2003; PCT/US03/08707, filed Mar. 17, 2003; and PCT/US03/08709, filed Mar. 17, 2003, each of which claims the benefit of and priority to U.S. Provisional Application No. 60/364,662 filed Mar. 15, 2002; the entire disclosure of each application listed above is hereby incorporated by reference and set forth in its entirety for all purposes.

This invention relates to internal combustion engines. In certain embodiments, this invention relates to internal combustion engines with integrated linear electric generators. In certain other embodiments, this invention relates to internal combustion engines with integrated pumping means.

There are well-known systems that use internal combustion engines to produce electric power. One such electric power generating mechanism is a generator that links the reciprocating action of a piston to generate magnetic flux change. A linear generator is essentially a coil and a series of magnets. "Coil" is understood as the windings plus the laminated flux path. "Magnets" is understood as permanent or electromagnets. Relative movement of the coil through the magnetic field induces an electric current.

There are various types of opposed piston and opposed cylinder combustion engines and various internal combustion engines with electrical power generating mechanisms. Several representative examples are discussed herein.

One example is U.S. Pat. No. 5,850,111 issued Dec. 15, 1998, which is incorporated herein by reference in its entirety for all purposes. This patent discloses a free piston variable stroke linear alternator alternating current (AC) power generator for a combustion engine with opposed cylinders and one moving element per piston pair.

Another example is U.S. Pat. No. 5,654,596 issued Aug. 5, 1997, which is incorporated herein by reference in its entirety for all purposes. This reference discloses a linear electrodynamic machine that includes one mover assembly and one stator assembly.

U.S. Pat. No. 3,541,362 discloses an opposed piston engine with two pairs of pistons, a crankshaft, connecting rods and at least one series of inductors comprising field magnets and pole pieces. The connecting rods cause reciprocation of oppositely moving members.

Other disclosures, such as U.S. Pat. Nos. 5,397,922; 4,873,826; or 4,649,283, describe internal combustion engines with linear generators. The aforementioned prior art devices all have one or more limitations. For example, they have undue complexity and quantity of the moving elements, such as crankshafts and wrist pins, and are thus not free-piston engines. Further, such prior art references do not have oppositely moving reciprocating mass elements so that the engines and associated electrical power generating mechanisms operate at a reduced level of vibration and efficiency. The prior art devices are also disadvantageous in that they may be heavy and noisy. Still further, existing systems may have low operating efficiencies and significant frictional losses. Additionally, dynamic imbalance in the existing systems results in extra wear on the reciprocating and related moving components.

An improvement to many of the shortcomings in the prior art, is disclosed in U.S. Pat. No. 6,170,443, which was invented by a common inventor and is under common ownership with this application, is incorporated herein by reference in its entirety for all purposes. The '443 patent discloses an internal combustion engine that has opposed cylinders, each with a pair of opposed pistons connected to a crankshaft with connecting rods, such as pushrods and pullrods. This system does not include electric power generating mechanisms. Also, this patent does not disclose a free-piston opposed piston opposed cylinder engine having three cylinders.

SUMMARY OF SELECTED EMBODIMENTS OF THE INVENTION

The present invention overcomes many of the foregoing disadvantages in the prior art and addresses an ever-present need for more efficient engines and electric power generating systems. As one illustrative example, the present invention incorporates an "Opposed Piston Opposed Cylinder" (OPOC) engine arrangement wherein two pistons are placed inside two opposed cylinders together with a central piston. The engine may be constructed as a two or four stroke system. The operation of the engine causes two opposed lines of movement in a common axis. By balancing the mass of each element, the result is a vibration-free reciprocating mechanical movement along a common axis.

An advantage of this invention is the availability of long and precise strokes in opposing directions and capability of operating on multiple fuels, including Gasoline, Diesel, Hydrogen, Methanol, Ethanol, JP6/8, or Natural Gas, for example.

Cooling of the engine may be facilitated by ribs or fins, as used in air cooling, or conduits as in fluid cooling, for example.

The vibration-free operation of this lightweight, compact and efficient internal combustion engine has many useful applications based on the opposed lines of movement, which have associated linking mechanisms for transfer of mechanical energy to power generating mechanisms or other applications. For example, the linking mechanisms may also transfer mechanical energy to gears and other structures to ultimately spin wheels or drive mechanisms, as in the case of any internal combustion engine.

The present invention particularly contemplates novel pumping mechanisms that may be used with a three-piston OPOC engine having at least one free piston. The pumping mechanism generally comprises two basic elements, a housing and a plunger slidably disposed therein. A linking mechanism may transfer mechanical reciprocation of one or more pistons to one or both elements of the pumping mechanism. The pumping mechanism may be used to transfer or compress fluids. Persons skilled in the art will recognize that the ability of the pumping mechanism to transfer or compress fluids make the basic pumping mechanism adaptable for performing pneumatic or hydraulic work, as well as any other fluid transfer or compression operation.

The present invention also contemplates certain novel arrangements of the basic elements of the pumping mechanism, which arrangements may be used with any form of engine providing opposed lines of movement. In one possible embodiment, the elements of the pumping mechanism are arranged to move in a parallel axis to an axis of movement to opposed lines of movement provided by a motivating means. In one variation of this general embodiment, the pump housing and plunger are disposed concentrically about the pump's motivating means. In a preferred embodiment, the motivating means is a three piston OPOC engine having at least one free piston.

Advantageously, the pumping mechanisms of the present invention may be adapted for use as a scavenging pump for an associated internal combustion engine.

As noted, one advantageous use of this invention is in an electric power cell whereby the OPOC engine is combined with an electric power or magnetic flux generating mechanism, such as a linear generator.

Various arrangements of coils and/or magnets are contemplated for use in an electric power cell so that relative motion of the coils and magnets produces flux. For example, one line of movement on the reciprocating central double-ended piston or two connected pistons may be used for the attachment of coil. A second line of movement, moving in the opposite direction from the first line of movement, may be utilized for the placement of permanent magnets or electromagnets. In addition, an optional stationary framework may include the required iron core and a coil. In this configuration, if the coil remains stationary, the first mover would also include a magnet and optional iron backer.

Upon operation of the engine, the system of magnets moves against the coil in one direction while the coil may be moved in the opposite direction. Thus, magnetic flux change can be induced by the relative movement between a magnet and a coil. The flux may travel through the winding, magnets and iron backer, or other structural elements as required.

As the stroke of the engine reverses its travel, both movers reverse their own generally parallel direction of travel, and still travel in opposing directions with relation to each other. Accordingly, the direction of travel of the flux, or current, through the coil reverses.

In one possible embodiment of a power cell, the elements of the flux generating mechanism are arranged to move in a parallel axis to an axis of movement to opposed lines of movement provided by a motivating means. In one variation of this general embodiment, flux generating elements are disposed concentrically about a power cell's motivating means. In a preferred embodiment, the motivating means is a three piston OPOC engine having at least one free piston.

The present invention can be constructed as a single phase, two phase, three phase, or any combination of phases by varying the composition of the coils in relationship to the framework of magnets and iron core traveling along the axis. A multi-phase power concept results in a smaller, more efficient, power electronics package.

The coils may be constructed according to the requirements of specific applications. Also, the number of phases may be configured as required by an intended application.

The number of magnets can vary according to application, size of the generator, number of phases, and frequency of the output and length of the stroke.

Cooling of the flux generating mechanism's components may be facilitated by gaps naturally designed in the assembly of the components and by the separation of the movers during each stroke.

The foregoing is not intended to be an exhaustive list of embodiments and features of the present invention. Persons skilled in the art are capable of appreciating other embodiments and features from the following detailed description in conjunction with the drawings.

BRIEF DESCRIPTION OF THE DRAWINGS

FIGS. 23*a-c* show an engine and associated mechanical mechanism according to the present invention.

DETAILED DESCRIPTION OF THE INVENTION

Figure 1:
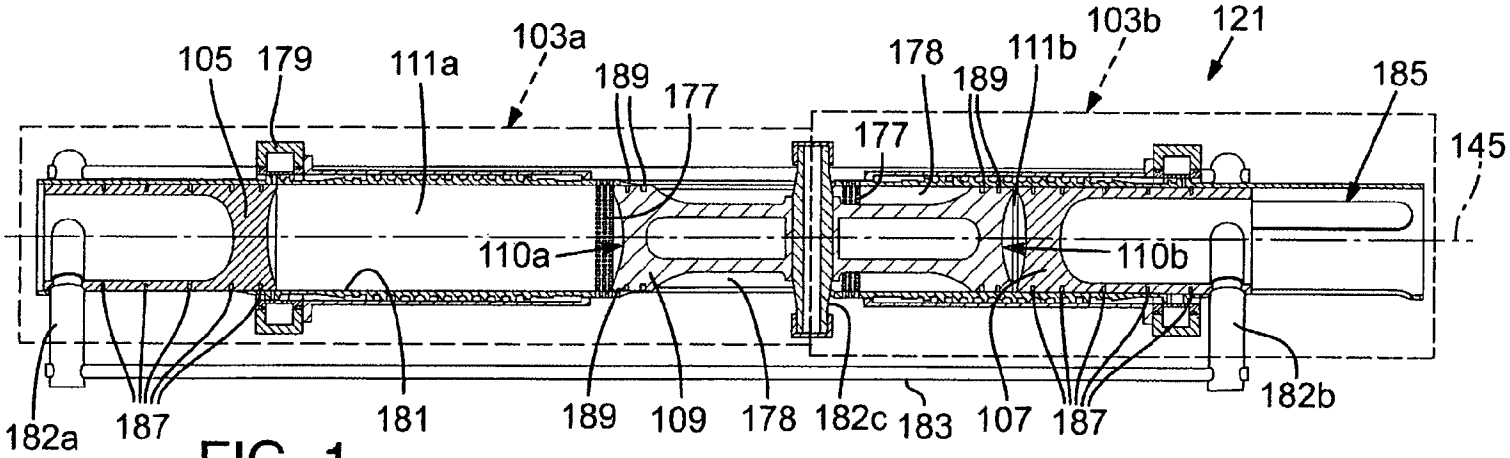
FIG. 1 is a cross-sectional view of one embodiment of an engine according to the present invention.

While the present invention is intended as a general purpose internal combustion engine, it is ideally suited for combination with secondary mechanisms such as an electric power generating mechanism, a hydraulic pumping mechanism, a pneumatic drive mechanism, a gear driven apparatus, or other mechanisms that can be coupled to connecting members or linking elements on the engine used to transfer mechanical energy associated with the movement of the pistons.

While an OPOC engine is generally discussed as including two cylinders opposed at 180 degrees, other cylinder arrangements that provide the necessary combustion chambers are also contemplated.

The connecting or linking element associated with one or more of the pistons may mechanically couple the linear, reciprocating motion of the pistons to elements external to the cylinders. For example, the arrangement of the cylinders and associated pistons provides the necessary mechanisms and framework, and may include slotted cylinders or associated structure to facilitate movement of connecting members and linking elements. In one particular example, described in more detail below, a linking element connects two outer pistons so that they move in tandem. Thus, as one outer piston moves inward, toward the central piston, the second outer piston moves outward, away from the central piston.

A second connecting member or linking element may be connected to the central piston. Thus, the movement of the central piston may also be transferred outside the cylinder. The central piston could also be connected to elements of an electric generator, hydraulic or pneumatic pump, or other apparatus inside the cylinder. Accordingly, as the outer pistons travel in tandem in one direction with the associated connecting member or linking element, the central piston, with its associated second connecting member element, would transfer an opposite direction of movement. These two opposed lines of movement, transferred outside the cylinder by respective connecting member elements may then be applied to many useful applications. One benefit, regardless of any additional application, is that the two opposed lines of movement may establish a balanced engine system.

The engine may include cooling fins or channels around the piston and may be optionally cooled by air, fuel or other coolant. Accordingly, appropriate cooling channels or air cooling fins may be included in the engine.

EXAMPLES OF AN OPOC ENGINE WITH FREE PISTON

The present invention contemplates an internal combustion, opposed piston and opposed cylinder ("OPOC") engine. Preferably, the OPOC engine uses one or more free pistons. As used herein, "free-piston" means a piston in a cylinder that is not connected to a crankshaft or other mechanism that controls its movement. The location of the piston in the cylinder generally depends on the forces from the combustion process, the forces of the energy transferring system (to mechanical, electrical, hydraulic or pneumatic energy), and the dynamic mass-forces. Two or more opposed free pistons may include a linking element that synchronizes the pistons.

Generally, the free-piston engine is contemplated as a two-stroke engine. However, four-cycle operation of the free-piston engine is contemplated. To operate as a four-cycle, special synchronization of the exhaust and intake ports are required. Also, it may be desirable to couple several free-piston engines together to realize a four-cycle process and compensate for any reductions in efficiency and also compensate unbalanced free mass forces.

Referencing to FIGS. 1 and 2*a-c*, one possible example of an opposed piston opposed cylinder (OPOC) engine 121 is illustrated. An opposed cylinder has a first cylinder 103*a* arranged 180 degrees from a second cylinder 103*b*. Two opposed outer pistons 105 and 107 are shown. Piston 107 is in the top dead center (TDC) position, while piston 105 is in the bottom dead center (BDC) position, as illustrated in FIG. 1. A central piston 109 is interposed between the outer cylinder pair 105 and 107. Central piston 109 forms a combustion chamber 111*b* with piston 107 and a combustion chamber 111*a* with piston 105. Alternatively, when at BDC, combustion chamber 111*a* may be termed a "displacement." However, herein the term "combustion chamber" will be used in a broad sense to include the general term "displacement," the actual combustion volume, and any volume defined between the cylinder walls 181, the respective outer piston 105 or 107 and the central piston 109. The pistons 105, 107 and 109 are aligned on a common axis 145. Inlet ports 177 and exhaust ports 179 are also shown. An optional linking element 183 is shown, connecting the outer pistons so that tandem movement may occur. To facilitate transfer of mechanical energy from the pistons, one or more connecting members are associated with one or more of pistons 105, 107, and 109. Connecting members 182 may pass through slots 185. Slots, such as slots 185 may be incorporated in the engine 121 to reduce the overall length of the engine. The connecting members can be discrete elements or an assembly of elements that move in unison. It is also noted that the term "linking element" used herein may be a form or continuation of the portion a connecting element that extends outside a cylinder in that the element moves in unison with the other portion of the connecting element. Instead of open slots in the cylinder, the connection member could be associated with a sleeve that so that no opening appears in the cylinder wall. Alternatively, connecting members (not shown in the drawings) may be connected to the underside of the respective piston 105 or 107.

EXAMPLE OF FREE PISTON FOR USE IN AN OPOC ENGINE

The central piston 109 may include two piston heads 110*a* and 110*b*. In this configuration, a compact design may be appreciated. Specifically, prior art pistons include relatively long piston skirts. The skirts help the prior art pistons from becoming stuck in the cylinder due to the lateral forces on the piston. However, piston 109 is a free piston, and is not connected to a crankshaft or other such device. Accordingly, there are no lateral forces and no need for skirts.

Referring again to FIGS. 1-2*a-c*, the double-headed 110 design of piston 109, wherein one piston head 110*a* forms a combustion chamber 11*a* with cylinder 103*a* and outer piston 105. A second combustion chamber 111*b* is defined with cylinder 103*b* and outer piston 107 having piston head 110*b*. This design obsoletes the piston skirt of the prior art because each piston head 110 guides the other piston head in its respective combustion cylinder. Because there are no lateral forces on the piston 105 or 107, there is no need for a long skirt to avoid piston sticking. The outer pistons 105 and 107 may also incorporate a small piston head 110 as in piston 109. But, because it is desirable to separate the hot exhaust gases from the chambers at the bottom side of the piston and allow them to escape, only in the exhaust ports 179, there may be additional piston length on the underside of the piston 105 or 107 to accommodate a series of cooperating piston rings, such as rings 187.

The design of central piston 109 allows for a compact overall package for the associated engine 121. The bottom side of the piston 109, as defined as the structure between the piston heads 110*a* and 110*b*, has unique features. Specifically, the bottom side of piston 109 cooperates with the cylinder wall 181 to form a chamber that buffers the pulsating flow of intake gas. This buffer chamber may be used as an intake gas chamber 178, for example. Intake gases, such as a desired fuel and the correct ratio of air, may be pre-loaded in the chamber 178 by known means. Then, as central piston 109 reciprocates along the common axis 145, intake ports 177, as shown in FIGS. 1 and 2*a-c*, may intersect with the moving chamber 178, allowing fresh intake gases to enter the respective combustion chamber 111*a* or 111*b*. No sealing is needed between the intake ports 177 and the chamber 178 underneath the piston heads 110*a* or 110*b*.

Piston rings 189 may be used to seal the combustion chamber 111 during the expansion and compression stroke and may be used to prevent the intake air and fuel mixture from prematurely entering the combustion chamber 111. Accordingly, piston 109 may be extremely short, as compared to pistons of the prior art. The central piston 109 needs only sufficient length to accommodate the two piston heads 110*a* and 110*b*, and piston rings 189. The walls of chamber 178, therefore, are defined by the space between the cylinder and the small geometry of central piston 109.

The outer pistons 105 and 107 also have unique features that assist the overall engine 121 package attain a compact configuration. One such feature is the inclusion of a connecting member 182 which may extend tangentially from a point or points on the surface of the piston 105 or 107, respectively. Cylinder 103 may include slots 185, which allow slidable motion of the pistons and associated connecting members 182. Because the slots 185 are positioned to minimize the length of the cylinder 103, gaps in the sealing of the associated piston 105 or 107 and the cylinder 103 will occur at the slot 185.

When a specific ring 187 overlaps or coincides with the slot 185, there will be a gap in the seal. Therefore, a series of cooperating rings 187 may be dispersed along the bottom of the respective piston 105 or 107 so that at least one ring overlaps or coincides the portion of the cylinder 103 containing the slot 185 and the exhaust ports, another ring may maintain an appropriate seal between the piston 105 or 107 and the combustion chamber 111. Additional details of the piston rings 187 and 189 are discussed herein.

Figure 6:
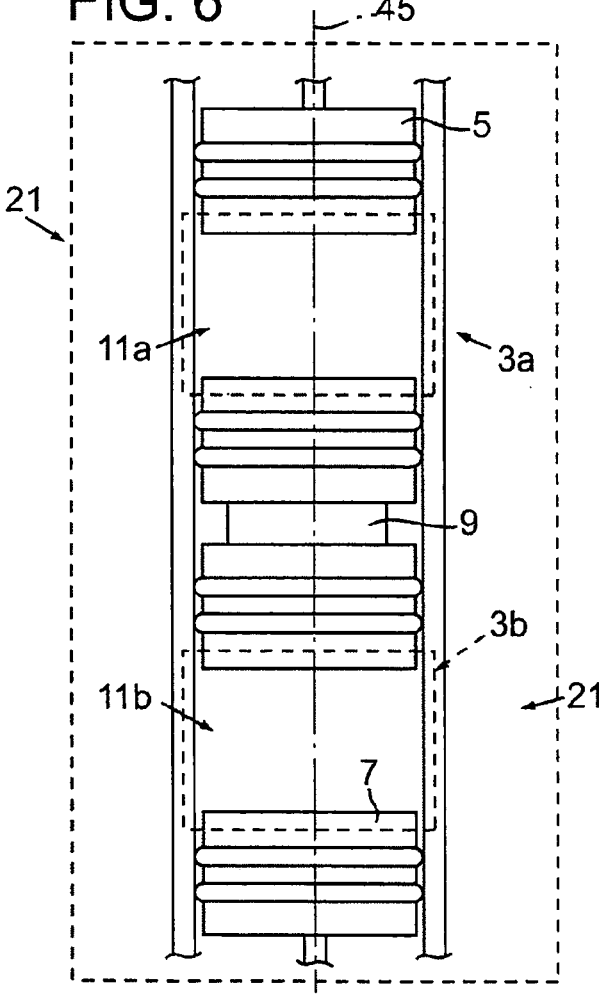
FIG. 6 shows a cross-section section of pistons and cylinder in accordance with the present invention.
Figure 9:
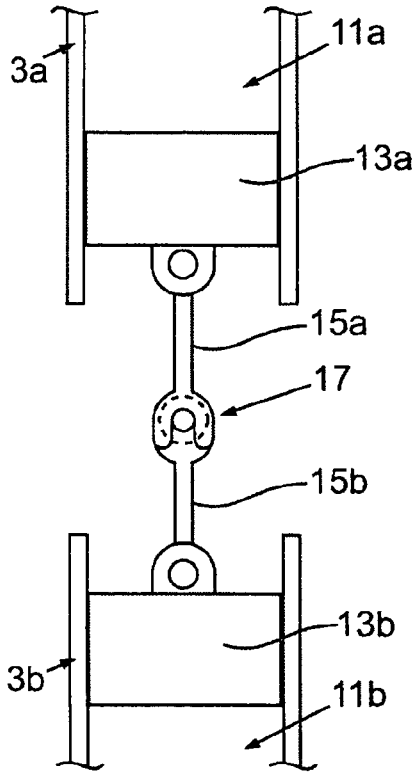
FIG. 9 shows an example of a central piston according to the present invention.

While the present invention is described relative to a set of three pistons, from the teachings herein, a person skilled in the art will understand how to create engines having varying piston numbers, such as a four piston configuration. As shown in FIG. 6, a simplified 3-piston OPOC engine 21 is illustrated. A central piston 9 forms two combustion chambers 11*a* and 11*b* within cylinders 3*a* and 3*b*. The opposite end of the cylinder is defined by outer pistons 5 and 7, respectively, which face an end of the central piston. FIG. 9 illustrates a modified central piston consisting of two linked central pistons 13*a* and 13*b*. Connection between the pistons 13*a* and 13*b* may be made with two connecting rods 15*a* and 15*b*, linked by a central pin 17.

EXAMPLE RINGS FOR USE WITH OPOC FREE PISTON ENGINE

The pistons 105, 107 and 109 are sealed against the respective combustion chamber 111*a* and 111*b* with conventional piston rings, for example piston rings 187 and 189, as shown in the accompanying figures.

Rings also seal the exhaust port against the combustion chamber and the buffer chamber.

The rings generally assist in attaining a compact and shorter overall engine. On the bottom side of outer pistons 105 and 107 there are a series of piston rings 187. These cooperate with the slots 185 so that as one seal is broken during piston travel due to the ring displacing over the slot 185, another ring in the series, for example, provides the necessary seal against the cylinder wall 181. In this manner, the exhaust port 179 remains isolated from the bottom chamber underneath pistons 105 and 107.

It should be noted that there is no sealing of the intake ports 177 against the intake gas chamber 178. This also is a significant factor in reducing overall length of the engine 121.

EXAMPLE OF INTAKE SYSTEM FOR USE WITH OPOC FREE PISTON ENGINE

Air, fuel, or any required pre-combustion gases may be introduced into the combustion chambers 111*a* and 111*b* by any known means. One suitable method of air introduction is connecting the cylinder to an inlet gas source by means of an intake gas chamber 178. The intake gas chamber 178 may be located under the central piston 109. Alternately, intake gases may be forced into the combustion chamber by using linking passages (not shown in the drawings). These passages may be smaller diameter channels, which may result in higher boost pressure of the gases as they are introduced into the respective combustion chamber 111.

By using known means of mixing and introducing fuel and air, any combustion process, such as Otto cycle, Diesel cycle, or HCCI (Homogeneous Combustion, Compression Ignition), for example, may be used.

EXAMPLE COMBUSTION SYSTEMS FOR USE WITH OPOC FREE PISTON ENGINE

The engine 121 of the present invention may be used with any number of fuels and combustion processes. For example, the engine 121 is suited for gasoline in an Otto cycle, which includes a homogeneous mixture of air and fuel, spark ignition, and throttle controlled with an external air/fuel mixture.

The engine is equally suited for a diesel fuel in a Diesel cycle, for example. Accordingly, a heterogeneous mixture with compression ignition, which is quality controlled (meaning the combustion is controlled by the mass of fuel injected), with an internal air/fuel mix in the chamber supplied by direct injection.

Additionally, the engine 121 may use a HCCI cycle. HCCI is understood to be a homogeneous mixture with compression ignition and either an outer or inner air fuel mixture. Other suitable methods of introducing fuel and air into the engine may work as well. For example, air and fuel may be mixed in the air belt, carburetors, or injection systems may be used.

Also, as with other types of engines of the prior art, the embodiment described herein may be used with either supercharging or turbo charging the air intake.

EXAMPLE TIMING AND EXHAUST SYSTEM FOR USE WITH OPOC FREE PISTON ENGINE

Figure 2A:
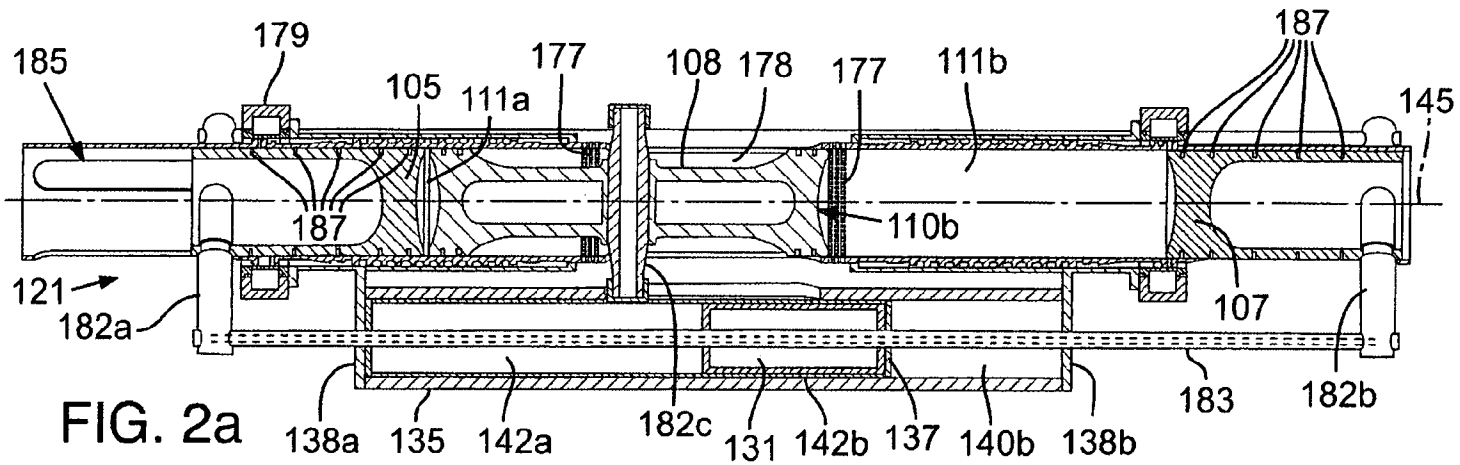
FIGS. 2*a-c* show a sequence in cross-sections of an engine and associated mechanical mechanisms according to the present invention. For example, pump elements are shown.
Figure 2B:
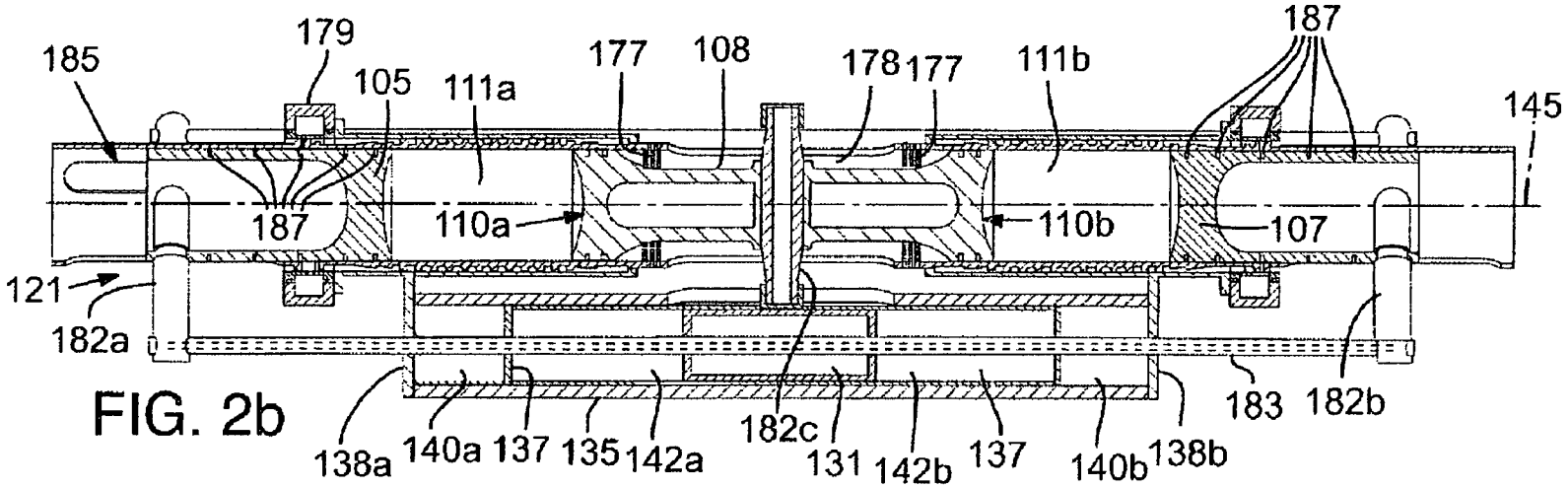
Figure 2C:
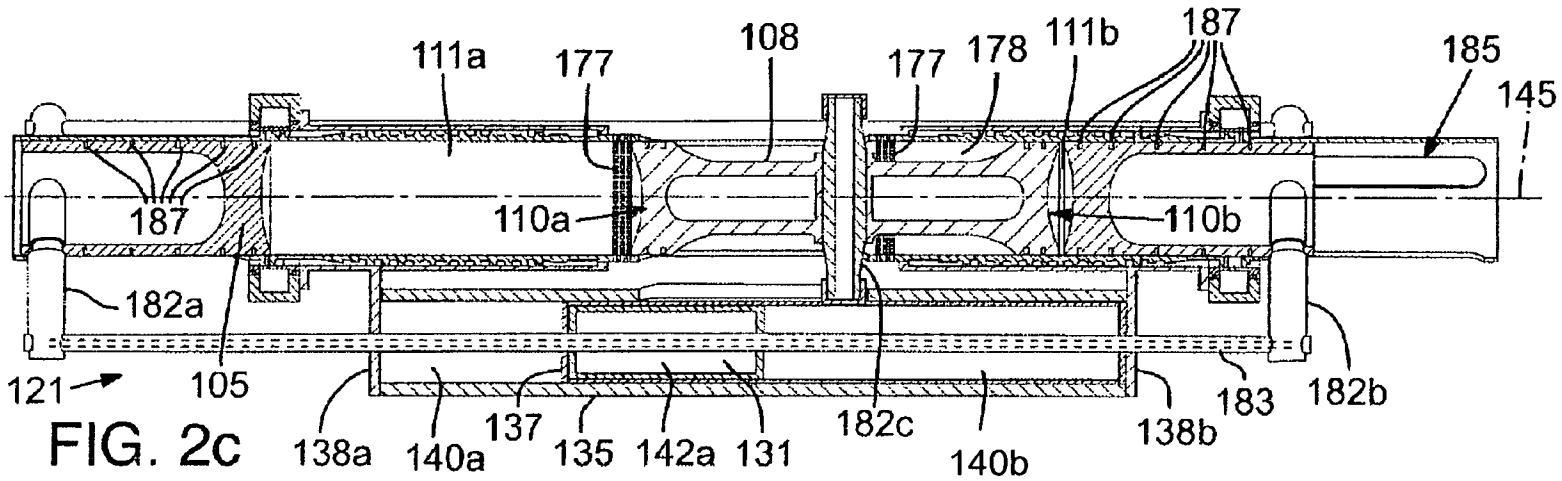

Referring specifically to FIGS. 2*a-c*, a sequence of the engine 121 is shown in three reference positions. FIG. 2*a* shows the OPOC engine 121 in the position termed bottom dead center (BDC) with respect to the right side of the engine 121. Or, more precisely, the combustion chamber 111*b*, defined by the cylinder liner, or cylinder wall 181, and the outer piston 107 and the central piston 109, is at BDC. FIG. 2*b* depicts the engine 121 in an intermediate position. And FIG. 2*c* depicts the engine 121 at top dead center (TDC) with respect to the same combustion chamber 111*b*.

For convenience, the engine 121 may be discussed in relation to one cylinder 103*a* (as shown in FIG. 1). However, the system is generally symmetric and there are similar elements and components in relation to both combustion chambers 111*a* and 111*b*.

The exhaust ports 179 are higher than the intake ports 177. The exhaust ports may have a height between 25-40% of the piston stroke. The intake port height may be between 10-25% of the piston stroke. The exhaust port may be approximately 15-20% of the piston stroke higher than the intake port. This allows the exhaust ports 179 to open first to allow the exhaust gas, which is under pressure, to escape from the combustion chamber to the exhaust ports before the intake ports open. Thus, the pressure in the cylinder 103*a* is reduced. Then, the intake ports 177 open and a desired air/fuel mix may enter the combustion chamber to start a new compression stroke. Generally, the sequence, in relation to one cycle of the cylinder 103*a* may be described as the exhaust port 179 opens first as the piston 105 and 109 separate after combustion. Then, the intake ports 177 are opened as central piston 109 moves from TDC toward BDC. Next, the intake ports 177 close and finally the exhaust ports 179 close. With outer piston 105 and central piston 109 at BDC, as shown in FIG. 2*c*, the cycle completes, and now reverses direction. Generally, this operation is due to symmetric timing of the engine 121.

At the same time as outer piston 105 and central piston 109 move from TDC to BDC in cylinder 103*a*, the outer piston 107 and central piston 109 move from BDC to TDC in cylinder 103*b*.

Alternatively, asymmetric timing of the pistons may be achieved by manipulating the sequence of the central piston 109 and outer pistons 105 and 107 by an apparatus that takes mechanical energy out differently (timely phased) from the central piston 109 and the outer pistons 105 and 107.

For a portion of travel, both the exhaust port 179 and inlet port 177 are simultaneously open, allowing a pressure ridge to develop to assist escapement of spent combustion gas.

A suitable embodiment may include that the outer pistons 105 and 107 are leading the central piston 109 up to 10% of the cycle time. While perfect balance may be achieved when the outer pistons 105 and 107 are moving exactly opposite to the central piston 109, this asymmetry allows desirable timing characteristics. Other features that enhance engine balance include matching each moving necessary engine element with a similarly massed element that always moves in an opposite direction, eliminating the need for additional massed elements for the purpose of balancing the engine. Another feature of this invention is the elimination of moving elements, as found in traditional engines, such as the crankshaft, cams, wristpins, linkages, valves and related components.

EXAMPLE OPERATING MODE FOR AN OPOC FREE PISTON ENGINE

In the OPOC engine the cylinder stroke CS is split into two piston strokes PS. The piston speed or velocity in a combustion piston engine is limited by tribological boundary conditions to approximately 14 m/sec. The optimal piston stroke PS to bore B ratio PS/B=1±0.15. That means: the OPOC engine has, at a given piston speed, two times the cylinder stroke of a conventional engine. This feature has unique advantages for the free piston OPOC combustion engine. The long cylinder stroke, approximately two times the bore B (CS~2×B) is the basis of a very efficient two stroke scavenging and improved thermodynamic system.

The displacement D of the engine of the present invention may be defined by the piston stroke PS and the bore B of the cylinders 103. One suitable embodiment has a first and second cylinder 103*a* and 103*b*, respectively. Each cylinder 103*a* and 103*b* has a length that is at least three and one-half times greater than the piston stroke PS plus the height of the piston head 110 of the central piston 109 and the additional length of the outer piston for the connecting elements 182*a*. This creates an overall length of the engine 21 of a minimum of eight times the piston stroke PS. For example, in a suitable embodiment the overall length is (9±1) times the piston stroke PS. The displacement D of one OPOC unit is: $D=PS\times B^2\times\pi$. The piston stroke PS should be (1±0.15) times the bore B, for example.

Engine Driven Pumping Mechanism

The present invention contemplates novel pumping mechanisms that may be coupled to engines providing opposed lines of movement, including the OPOC engines described herein. One useful application of the OPOC engine 121, discussed above, is as a motivating mechanism for an external pump apparatus, an example of which is shown in FIGS. 2*a-c*. However, the pump apparatus could be any number of devices that could make use of the linear reciprocation of the pistons 105, 107 and 109. Accordingly, connecting members, such as members 182*a*, 182*b*, and 182*c* may be attached or linked to the respective pistons 105, 107 or 109, to transfer this mechanical energy outside the OPOC engine 121. One such contemplated pumping apparatus may be an electric power cell. Another application may be a pneumatic compressor, or a hydraulic pump. In other words, the pump may be used to compress or transfer any fluid in communication with an intake valve on the pump. Suitable adaptations would be easily understood in the art.

For illustrative purposes, a general pumping mechanism will be described. Making specific reference to FIGS. 2*a-c*, an OPOC engine 121 is illustrated with an external pump assembly consisting of a housing 135 and a first plunger 131 connected to the linking element 183 from the engine 121 at outer pistons 105 and 107 via a respective connecting member element 182. Also shown, is an optional second plunger 137, connected to the engine 121 at the central piston 109 by connecting member 182*c*

The housing 135 may be external to the engine 121. As shown in the drawings, the housing 135 may be arranged around the engine 121, so that the pump action of the first plunger 131, and optional second plunger 137, is generally parallel to the common axis 145.

If the general pump apparatus includes both a first plunger 131 and a second plunger 137, then two opposing lines of movement will result when the first plunger 131 is connected to pistons 105 and 107, and the second plunger 137 is connected to piston 109. Thus, the overall system 121 may retain desirable balance, vibration and noise characteristics. In this configuration, a double pump in a common chamber may be achieved.

In a typical embodiment, which may be integrated with an internal combustion engine, air, fuel or both are introduced to the housing 135 by a series of reed valves (not shown in the FIGS.). As used herein, mixture is intended to include any proportion of fuel and air from pure air and no fuel, to pure fuel and no air. At least one reed valve may be placed at one or both ends of the housing 135, for example ends 138*a* and 138*b*. In this manner, the mixture is drawn into the housing 135 through an appropriate valve by the pumping action of the first plunger 131, and the optional second plunger 137. For example, in FIG. 2*c*, when piston 105 is at bottom dead center, a chamber 140*a* defined by the inner wall of the housing 135 and the first plunger 131 is created in the housing 135. The movement of the plunger 137 creates a reciprocating volume, and therefore the chamber may be split into a left side 140*a* and a right side 140*b*. When the plunger 137 is displaced to the right, the volume of the left side 140*a* increases and the pressure reduces. As the pressure in chamber 140*a* is lower than the pressure outside the housing 135, the mixture is drawn into the chamber 140*a* through a reed valve (not shown), for example. When piston 105 displaces from bottom dead center to top dead center, the plunger 137 reverses direction and the mixture in chamber 140*a* compresses and is forced into gas inlet chamber 178 by known means, such as a conduit, a channel or other such passage. A second series of reed valves (not shown) may be placed between the housing 135 and the engine inlet ports 177. The reciprocal action, in a like manner, causes the mixture to be drawn into chamber 140*b*, and otherwise operates similar to the process just described.

Fluid or air may be introduced to the pump apparatus by incorporating a tube in linking element 183. For example, the linking element 183*a* may be a hollow pipe wherein air or fluid may pass from external of the engine 21 and be delivered internal to the housing 135 and be distributed to any combination of the housing's internal cavity, the first plunger 131, or the optional second plunger 137. Accordingly, the fluid or air may be used for any number of purposes. For example, the fluid or air could be used to cool the components. In another example, the fluid or air could be used in a pneumatic or hydraulic cylinder, so that work may be performed external to the engine 121. It is understood that if the pump apparatus is used with a gaseous mixture, such as air and fuel, that the plungers would compress the volume. However, the pump apparatus may also be used to displace a volume of fluid, such as a hydraulic fluid.

The arrangement of the external pump may be a continuous element that circumferentially wraps the common cylinder 103, e.g., there is a concentric arrangement of pump around the engine. Other arrangements that adapt the pump to the opposed lines of movements provided by the pistons in an OPOC engine may be equally suitable.

EXAMPLE OF SCAVENGING PUMP

Referring to FIGS. 1 and 2*a-c*, one use of the "double pump," consisting of a first plunger 131 and a second plunger 137 in a common housing 135, may be to introduce fuel and air into the engine 121. This application, for convenience, may be referred to as a scavenging pump. While this invention contemplates and describes a double pump, it should be understood that a suitable embodiment may include a single pump.

Figure 3A:
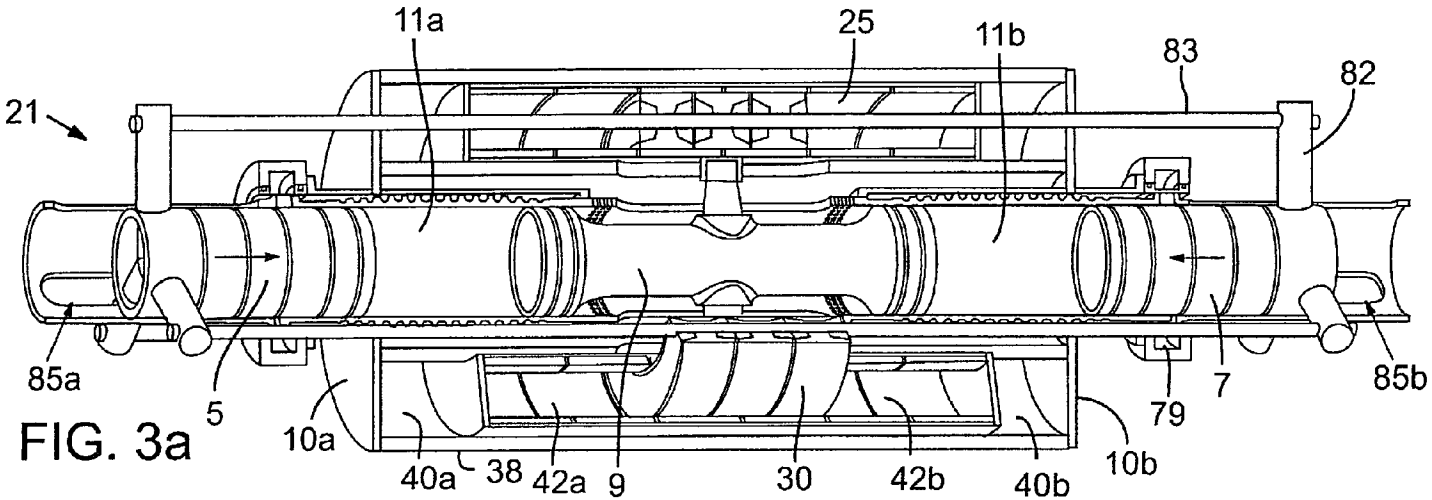
FIGS. 3*a-c* show a sequence, in isometric cross sections of an engine and electric power generating mechanisms according to the present invention.
Figure 3B:
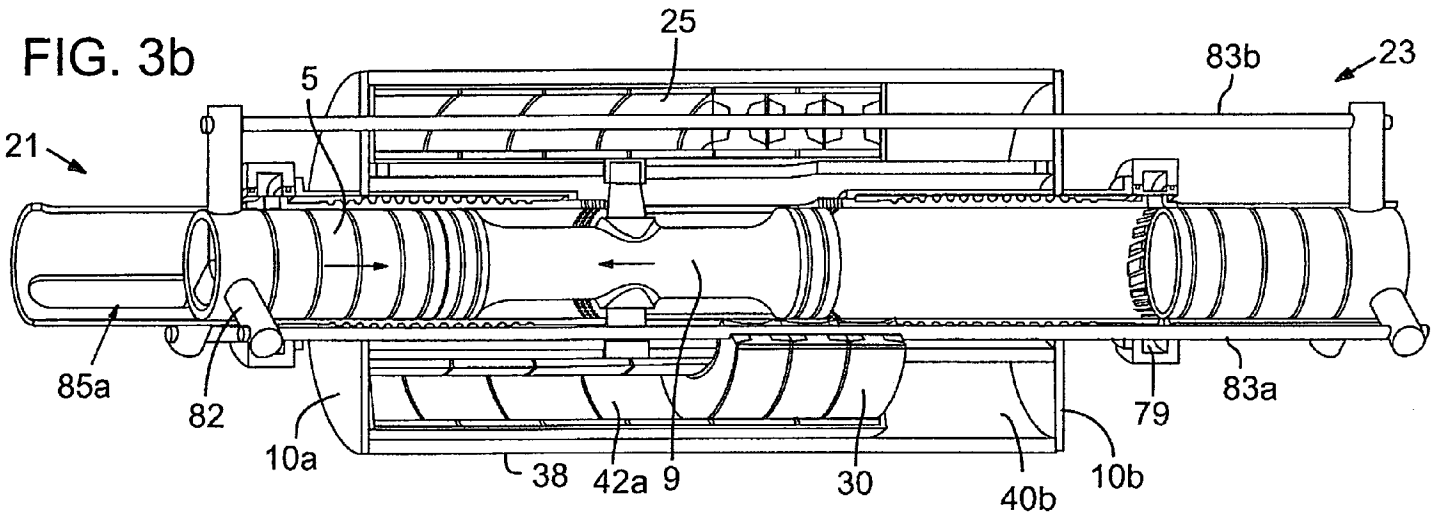
Figure 3C:
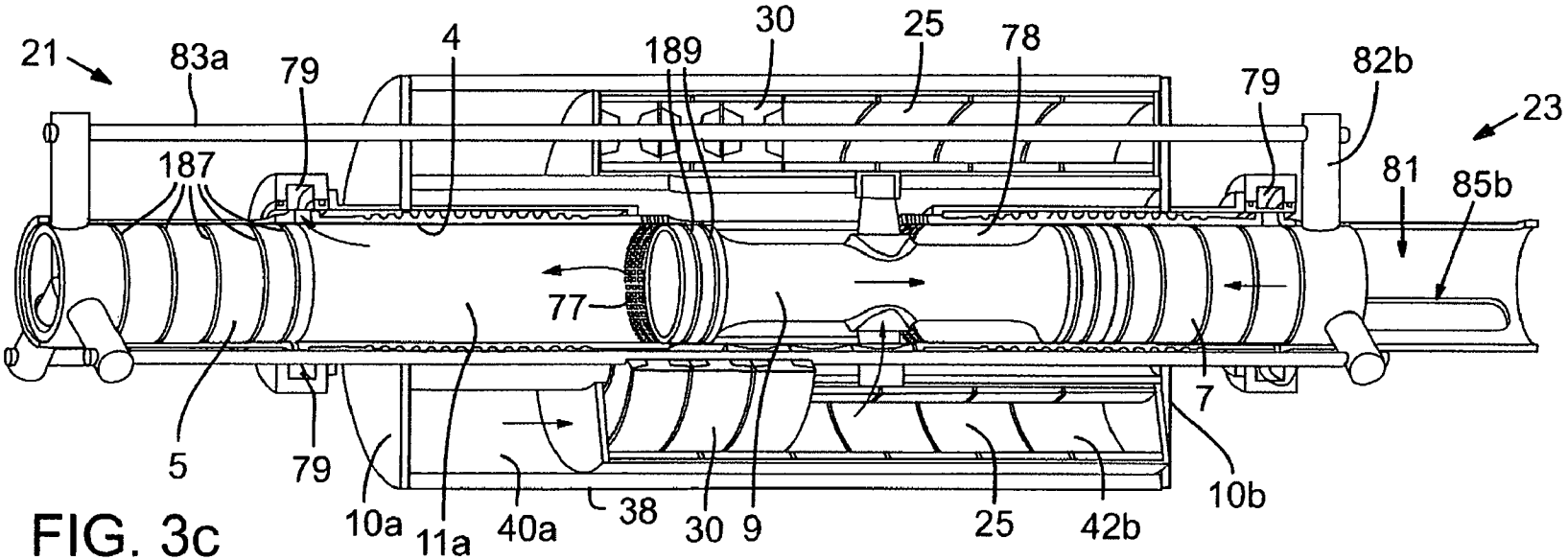
Figure 4A:
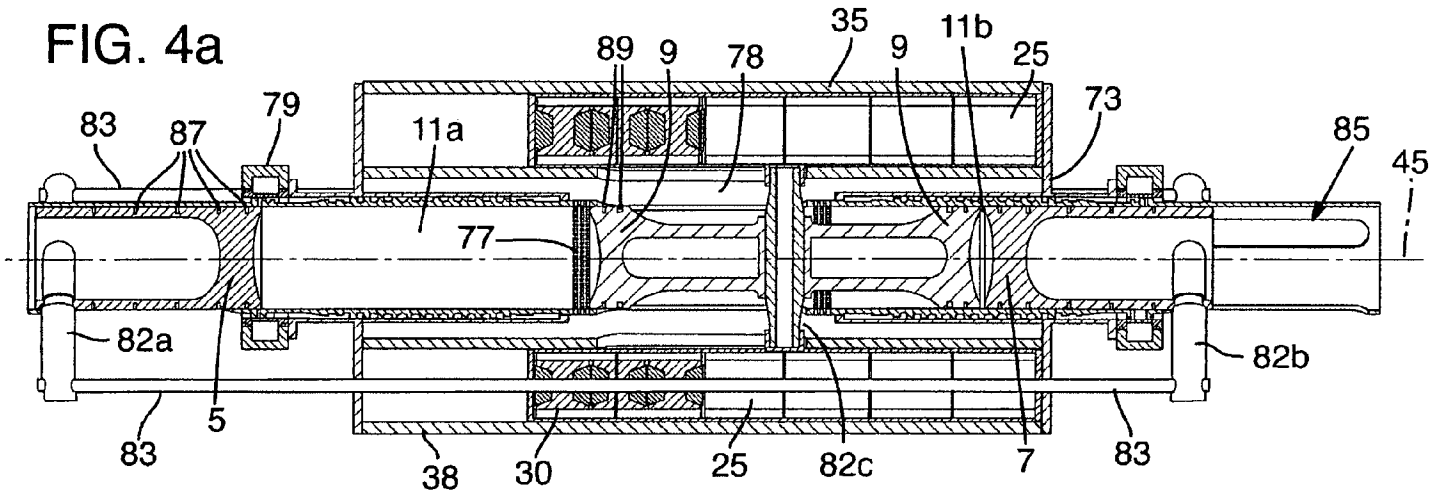
FIGS. 4*a-d* show a sequence in cross sections of an engine and electric power generating mechanisms according to the present invention.
Figure 4B:
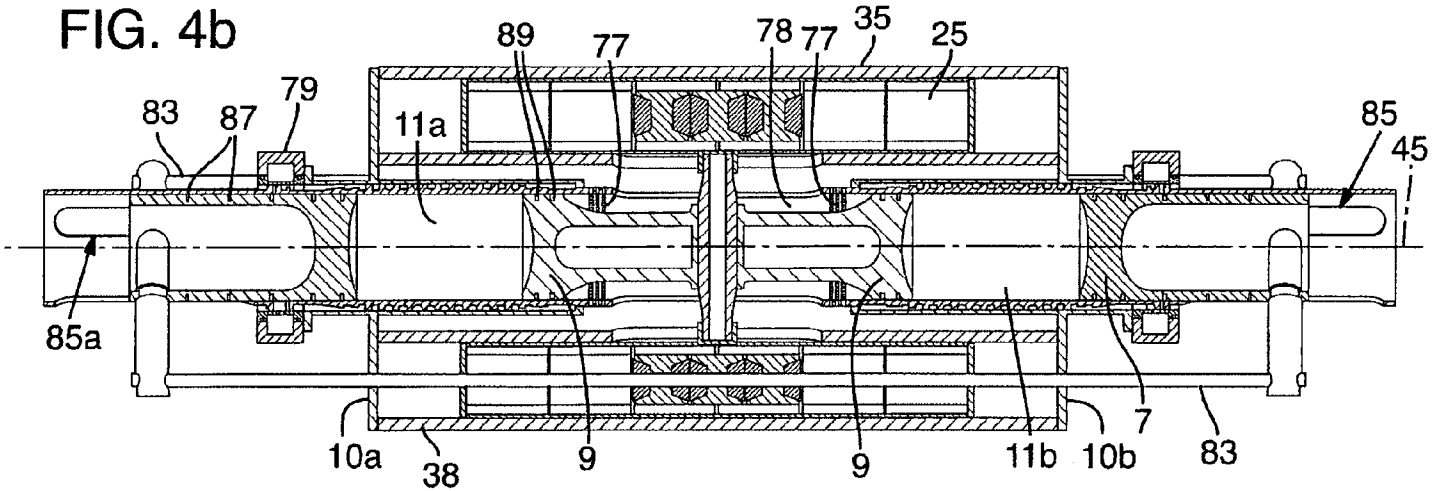
Figure 4C:
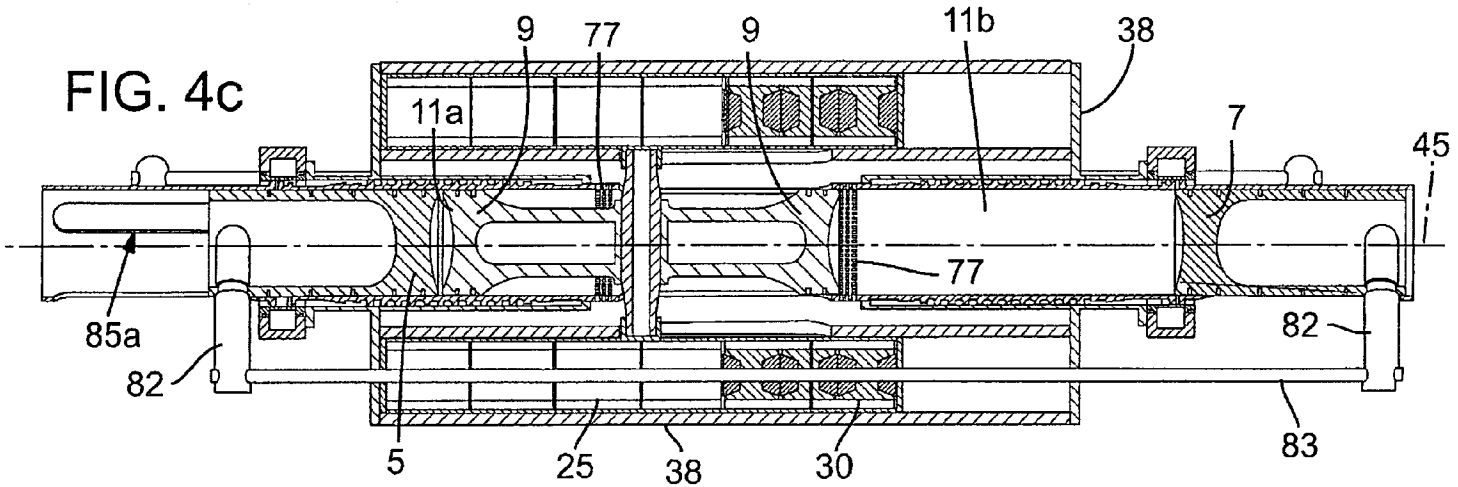
Figure 4D:
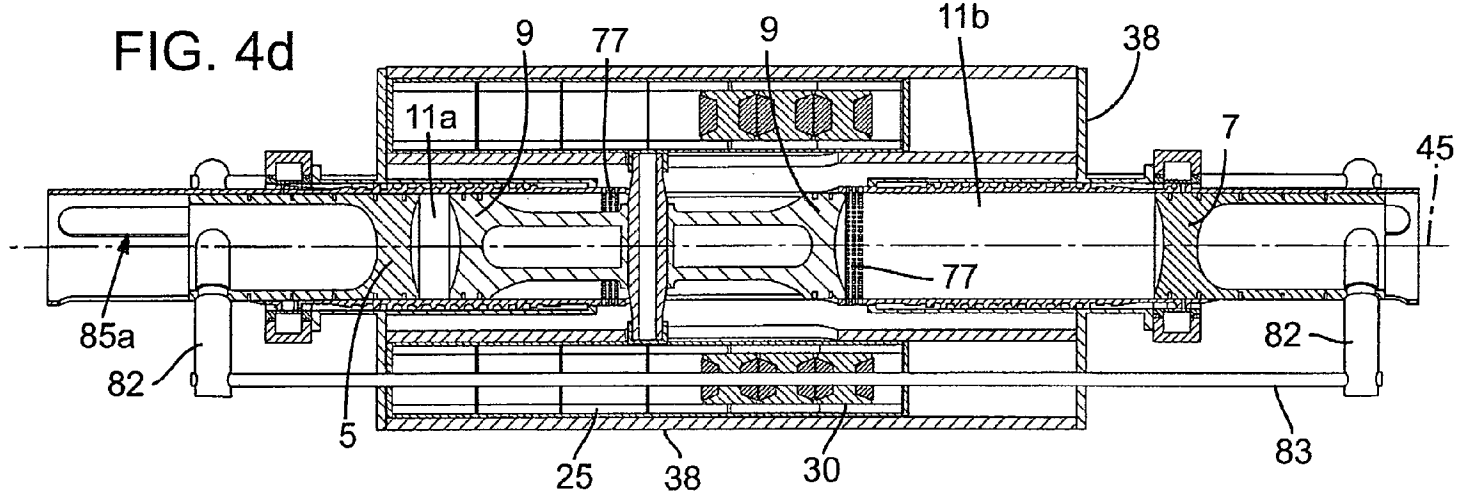

Referring now to FIG. 3*a-c*, a scavenging pump connected to an OPOC engine 21 is illustrated. Used as a scavenging pump, intake gases, which may include any desired proportion of fuel and air, are introduced into the housing 38 by known means. For example, the fuel may be injected under high pressure, such as approximately 2000 bar, or as otherwise required in a Diesel combustion process. Another example would be a low pressure injection, as could be provided by a single solenoid, where an electric signal causes the solenoid plunger to open and thereby inject fuel at a low pressure into the housing or in the air belt near the intake ports.

In a typical embodiment air, fuel or both are introduced to the housing 38 by a series of reed valves (not shown in the Figs.). As used herein, mixture is intended to include any proportion of fuel and air from pure air and no fuel, to pure fuel and no air. At least one reed valve may be placed at both ends of the housing 38, for example ends 10*a* and 10*b*. In this manner, the mixture is drawn into the housing 38 by the pumping action of the first plunger, such as coil 30, and the second plunger, such as magnet 25.

Coil 30 acts as a first plunger in a chamber 42 defined by the circumferentially arranged magnet 25. As the coil 30 reciprocates in chamber 42, any volume of fluid or air may be compressed and directed into the engine 21 by at least one cooperating reed valve. Similarly, magnet 25 may act as a second plunger in a chamber 40 defined inside the circumferentially arranged housing 38. A reed valve may be placed between chamber 40 and chamber 42 to assure a unidirectional flow of the fluid or air or both. In one embodiment a series of reed valves may be placed between chamber 42*a* and chamber 40*a*, as well as a second series of reed valves between chamber 40*b* and 42*b*. Thus the fluid or air will be drawn into the respective chamber during an expansion stroke and forced into the next chamber or engine in the compression stroke.

EXAMPLE ELECTRIC POWER CELLS ("EPC")

The present invention contemplates novel electric power or flux generating mechanisms generally based on two linearly and oppositely moving elements or a reciprocating element and a stationary element, one element being a coil or a series of coils, the other a magnet or series of magnets, the elements being arranged so that the relative motion induces magnetic flux. FIGS. 3-23, show examples of novel electric power cells, flux generating mechanisms, and related components, according to the present invention. (Similar features have the same reference numeral or the same last two digits in the case of three digit numbers.)

EXAMPLES OF FLUX GENERATING MECHANISMS FOR USE IN FORMING ELECTRIC POWER CELLS WITH MOTIVATING MEANS PROVIDING OPPOSED LINES OF MOVEMENT

The novel flux generating mechanisms described herein may be combined with any mechanism that generates two opposing lines of movement. One such contemplated mechanism may be an internal combustion engine having synchronized elements that can transfer mechanical energy in two opposing directions, simultaneously. Accordingly, one contemplated novel application of an OPOC engine, such as engine 21, is to generate electric current in an electric power cell using the flux generating mechanisms described herein. In the embodiments described herein, transfer of the alternating current from the flux generating mechanism to outside the described system may be accomplished by any known method. One example of a contemplated transfer method is using electric brushes or sleeve contacts in electrical connection with linking elements 83*a*, 83*b* and 83*c* shown in FIGS. 3-5.

As used herein, "magnet" means a permanent magnet, an inductive magnet, or other means for providing a magnetic field. In addition, magnet refers to a Halbach series that, relative to a direction perpendicular to the common axis 45, includes an alternating sequence of north polarity and south polarity magnets with alternating east and west magnets dispersed in between. Equally suitable, is a set of magnets that includes a series of alternating north and south polarity magnets. The term magnet may also include an iron backer in direct physical contact with the magnetic components.

The term magnet may also indicate that the iron backer is separated by an air gap from the magnetic components. These various definitions of the term magnet are illustrated in the accompanying drawings.

As used herein, "magnetically inducible flux element" means a structure upon which a magnet may act to induce flux. Typically, the magnetically inducible flux element will be a coil, namely a winding of an electrically conductive substance, for example copper or aluminum wire. For convenience, hereinafter, unless context indicates otherwise, the term "coil" shall be used interchangeably with "magnetically inducible flux element". Accordingly, an elegant wound coil, a coil winding, a field winding, a surface winding or other such devices are within the contemplation of this invention.

An insulating material may be placed between wires or between layers of wires, thereby allowing a stack or winding of several layers or rows of wire.

The moving elements of a flux generating mechanism can be any combination of magnets, coils or back iron that induce flux generation from their relative movement. The moving element may be stationary support structure. Thus, using the principle of relative motion between a coil and a magnet to create a change in flux and induce a voltage in the coil that may result in electric current, any number of suitable moving elements and combinations of appropriate cooperating moving or stationary elements can be used.

Illustrative arrangements of stationary and moving elements are shown in FIGS. 7-20. These components may be combined with the OPOC engines contemplated herein. Alternatively, any other motivating mechanism that provides two opposed lines of movement may be used in combination with the arrangements of flux generating elements.

Figure 7A:
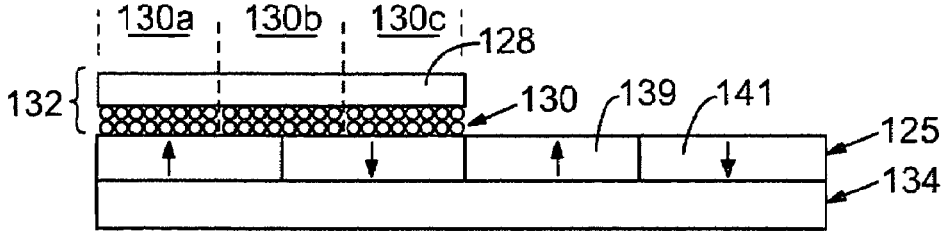
FIGS. 7*a-c* show elements of a magnetic flux generating mechanism in accordance with the present invention.
Figure 7B:
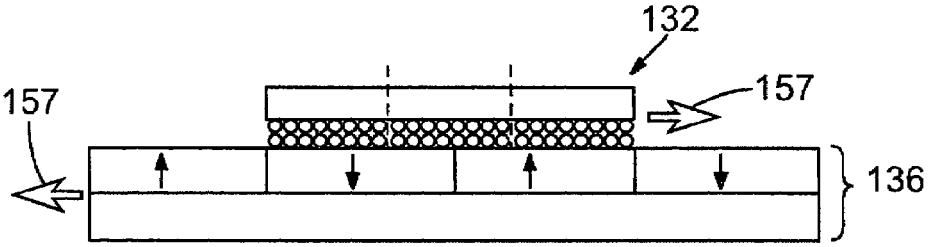
Figure 7C:
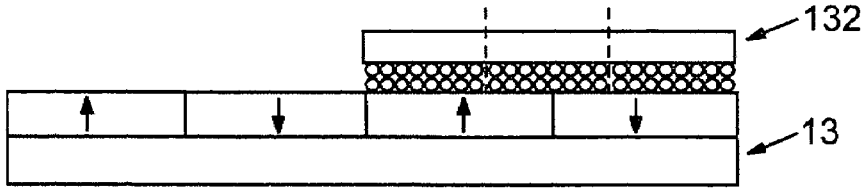

In one possible embodiment shown in FIGS. 7*a-c*, a surface mount coil 132, comprising at least one coil 130 connected to a back lamination 128, may move against a moving magnet 125. The surface mount coil 132 may include a series of surface mounted coils 130. For example, three sets of surface mount coils, 130*a*, 130*b*, and 130*c* may be attached to a common moving back lamination 128. This coil 132 may then move in relation to the magnet 125. The magnet may be a series of alternating north polarity magnets 139 and south polarity magnets 141 and may also include an iron backer 134 to form assembly 136. In a desired embodiment, the ratio of coil segments 130*a* 130*b* and 130*c*, to magnets 139 and 141 is 3:2 to create a three phase current. The relative motion of the elements is shown by arrow 157.

Figure 8A:
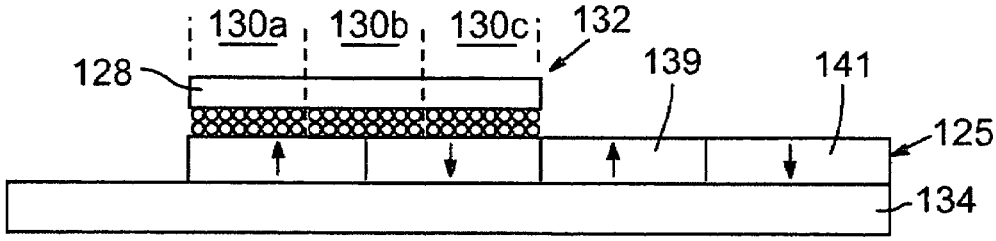
FIGS. 8*a-c* show elements of a magnetic flux generating mechanism in accordance with the present invention.
Figure 8B:
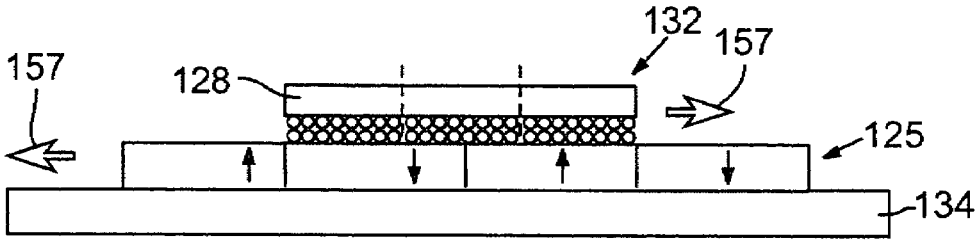
Figure 8C:
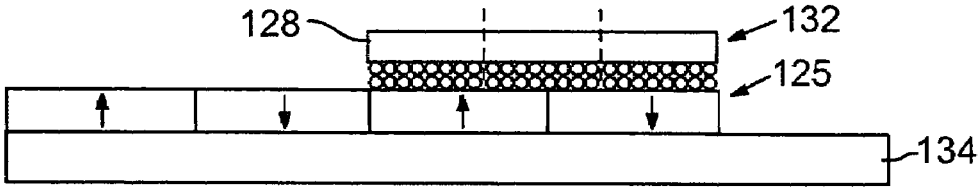

Referring to FIGS. 8*a-c*, a moving coil 132 is shown with relative motion in relation to a moving magnet 125. In this example, the coil includes three sets of surface mount coils 130*a*, 130*b*, and 130*c*, all attached to a common back lamination 128. The magnet 125 includes a series of alternating north and south polarity magnets 139, 141, respectively. However, in this example, the iron backer 134 is held stationary and is laminated. Again, a desired ratio of coils 130*a*, 130*b* and 130*c* to magnets 139 and 141 is 3:2 to create a three phase current.

Figure 10A:
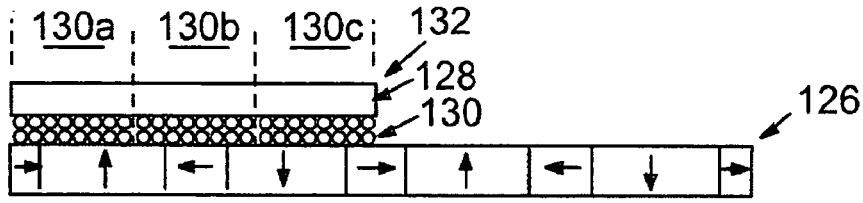
FIGS. 10*a-c* show elements of a magnetic flux generating mechanism in accordance with the present invention.
Figure 10B:
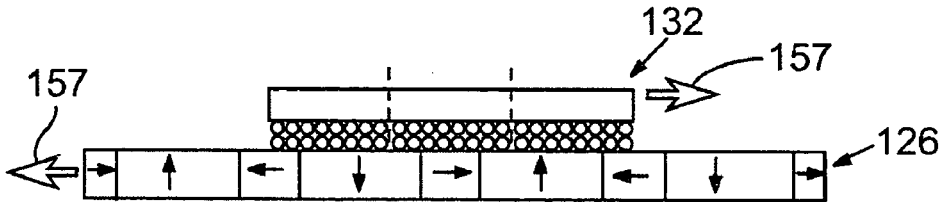
Figure 10C:
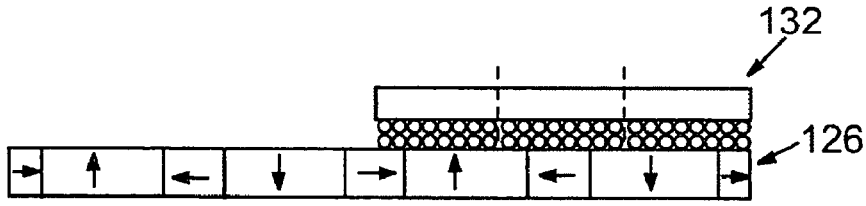

FIGS. 10*a-c* illustrate a surface mount coil 132 having three sets of coils 130*a* 130*b* and 130*c* with a laminated backing 128, moving in relation to a moving magnet 126. The magnet 126 is a series of Halbach magnets.

Figure 11A:
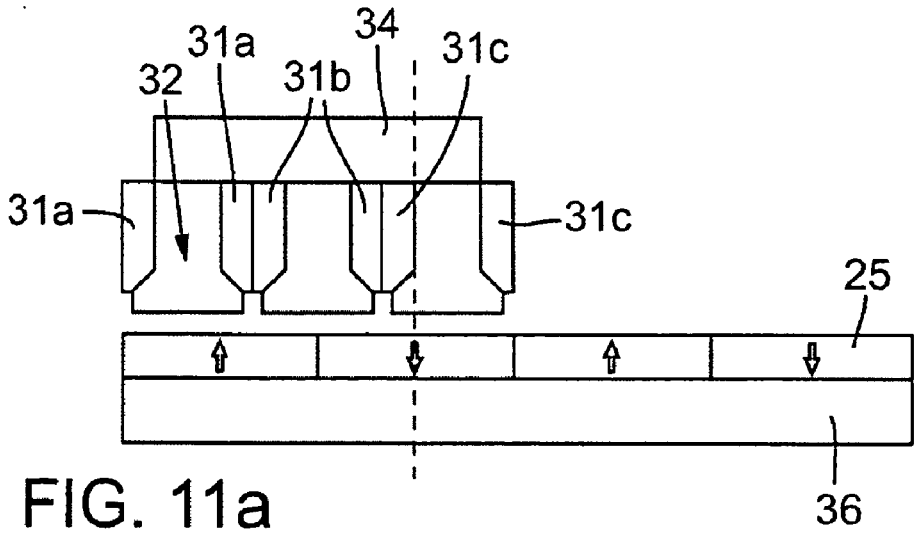
FIGS. 11*a-c* show elements of a magnetic flux generating mechanism in accordance with the present invention.
Figure 11B:
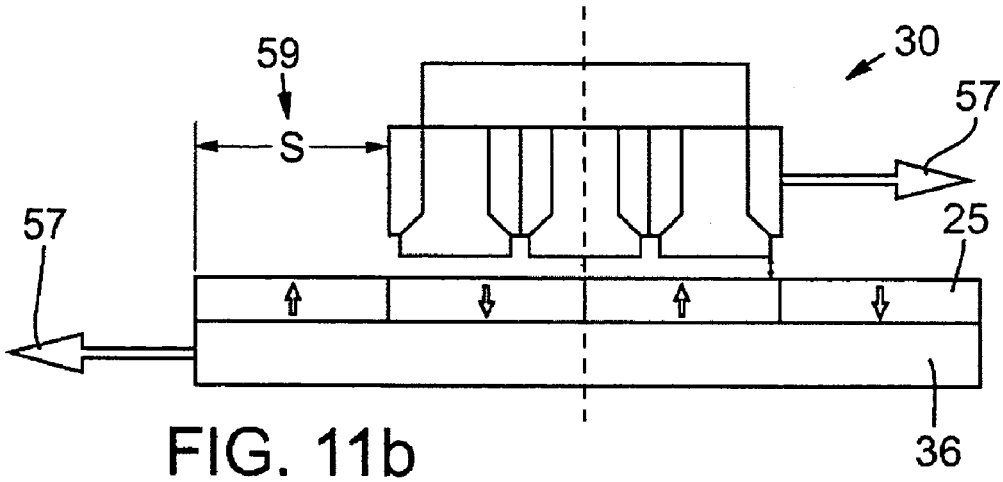
Figure 11C:
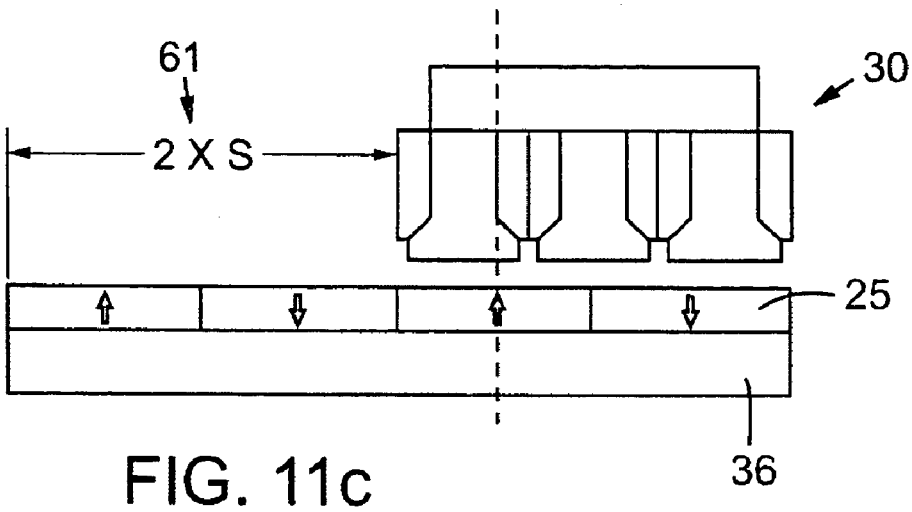

A coil winding 30, as shown in FIGS. 11*a-c*, is another suitable moving element. Again, the magnet 25 may comprise a series of alternating north magnets 39 and south magnets 41 and also may include an iron backing 36. The magnet 25 and backing 36 comprise a second moving element. The coil 30 may include a laminated backing 34 and teeth 32. The teeth 32 separate each set of coil windings, 31*a*, 31*b* and 31*c*. Again, the ratio of coil windings 31*a*, 31*b*, and 31*c* to magnets 39 and 41 is 3:2 to create a three phase current.

Figure 12A:
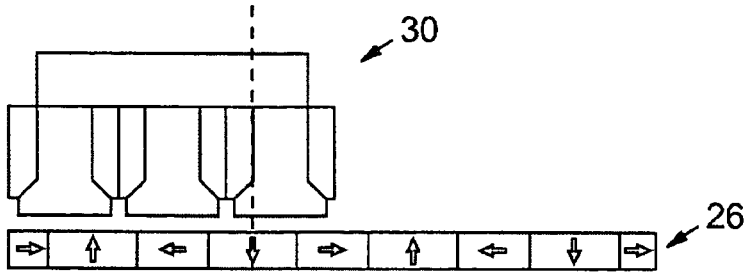
FIGS. 12*a-c* show elements of a magnetic flux generating mechanism in accordance with the present invention.
Figure 12B:
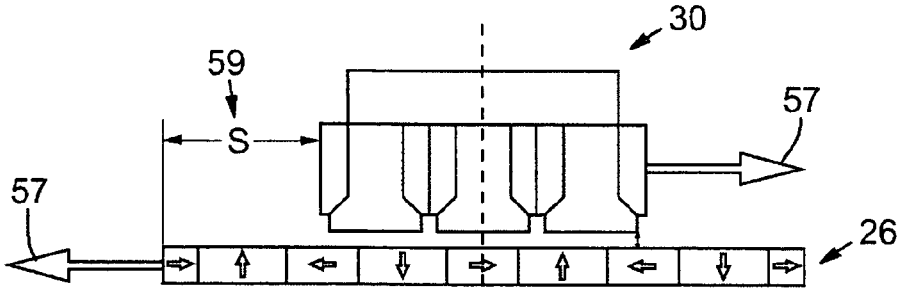
Figure 12C:
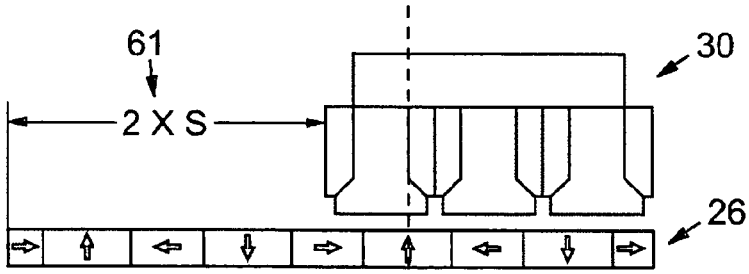

FIGS. 12*a-c*, describe a coil 30 moving in relation to a moving Halbach series of magnets 26. As previously discussed, the coil 30 has teeth 32, which separate each set of windings 31. Because the second mover is a Halbach series of magnets 26, no iron backer is required.

Figure 13A:
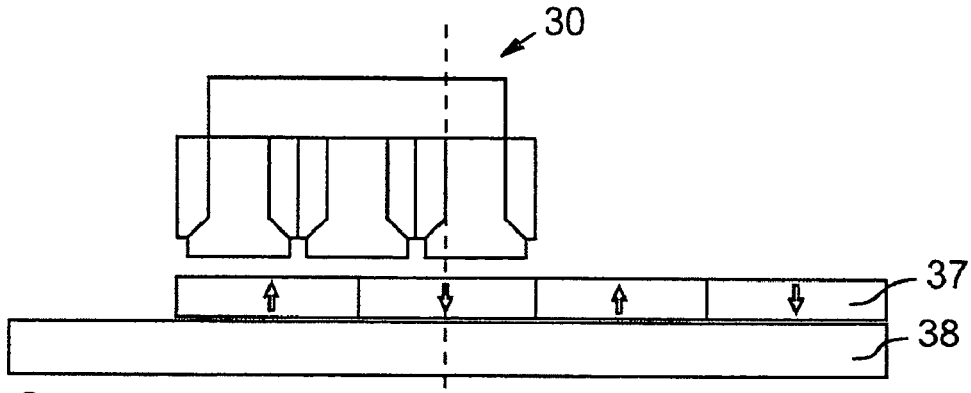
FIGS. 13*a-c* show elements of a magnetic flux generating mechanism in accordance with the present invention.
Figure 13B:
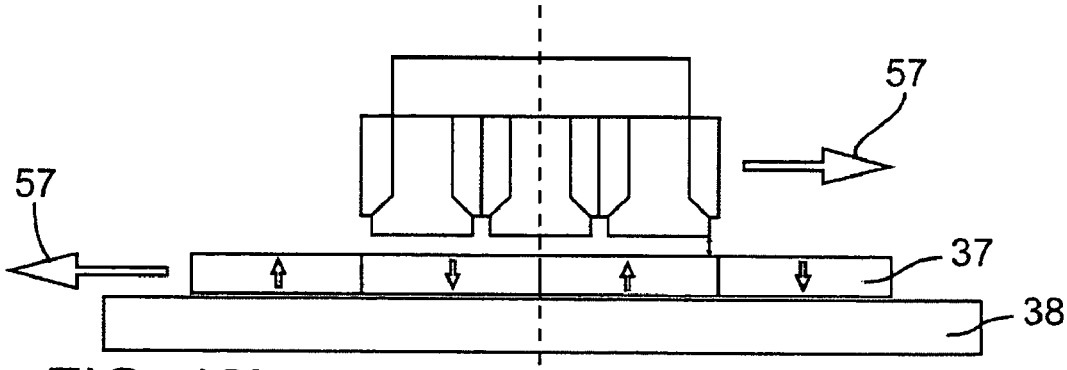
Figure 13C:
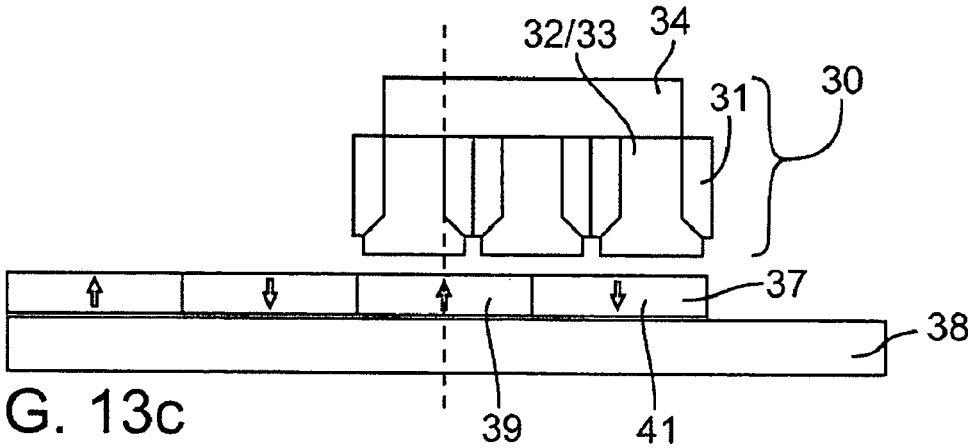

FIGS. 13*a-c* illustrate a coil 30 moving in relation to a moving magnet 37. Here, the magnet 37 is separated from an iron backer 38. The iron backer 38 remains stationary in relation to the magnet 37 and is laminated.

In each of the foregoing descriptions of FIGS. 7-13, one moving element is the coil and the second element is the magnet. Each moving element would require a separate but opposite line of movement.

Figure 14A:
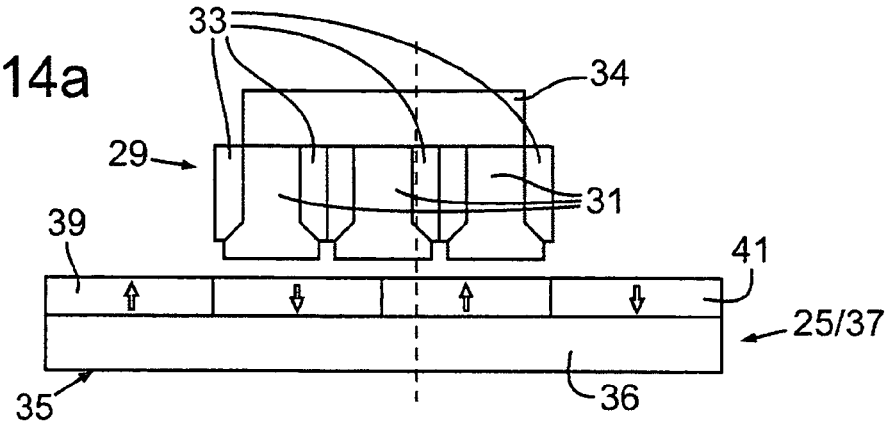
FIGS. 14*a-c* show elements of a magnetic flux generating mechanism in accordance with the present invention.
Figure 14B:
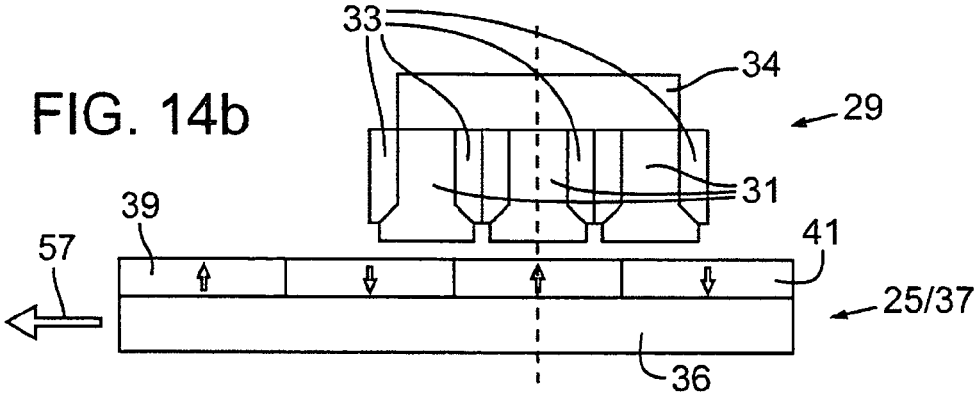
Figure 14C:
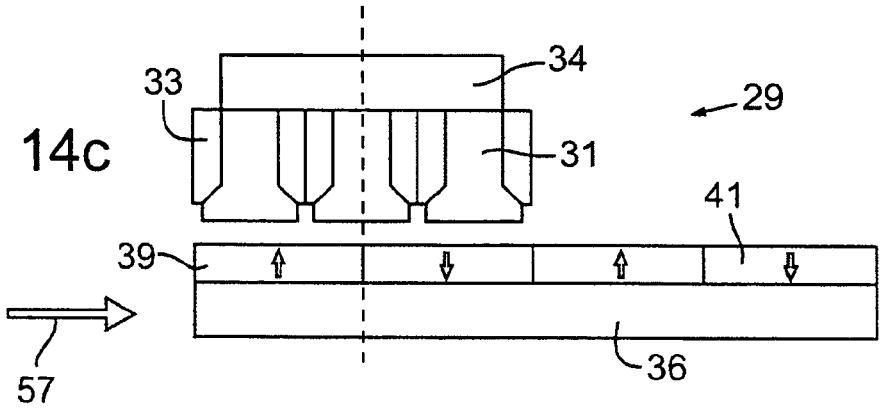

An alternative embodiment, shown in FIGS. 14*a-c*, describes a stationary coil 29 with a moving magnet 25/37. In this embodiment, the coil 29 includes winding separators, such as teeth 31, that separate the windings 33. A backer 34 is also included with the coil 29. At least one magnet 25/37 moves relative to the stationary coil 29. The magnet may include a moving backer 36, as shown.

Figure 15A:
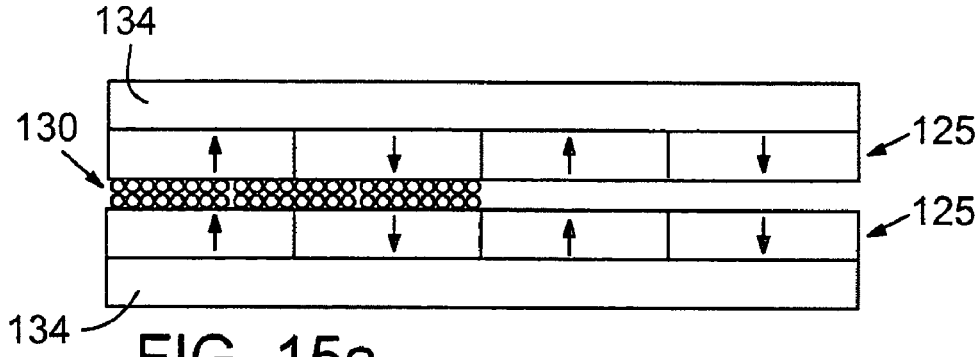
FIGS. 15*a-c* show elements of a magnetic flux generating mechanism in accordance with the present invention.
Figure 15B:
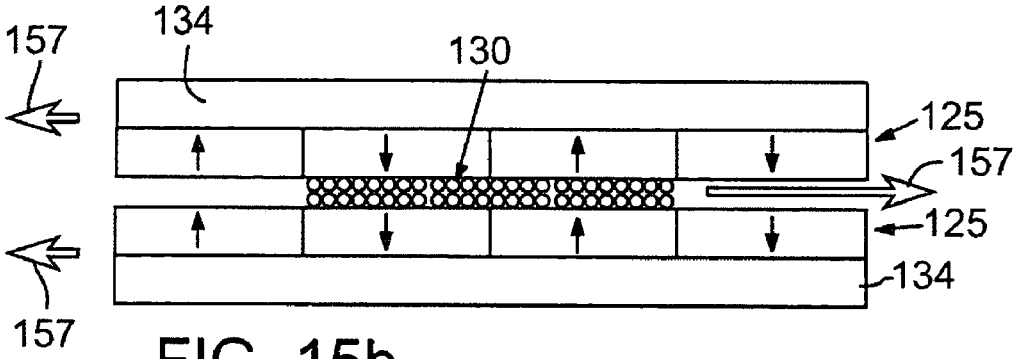
Figure 15C:
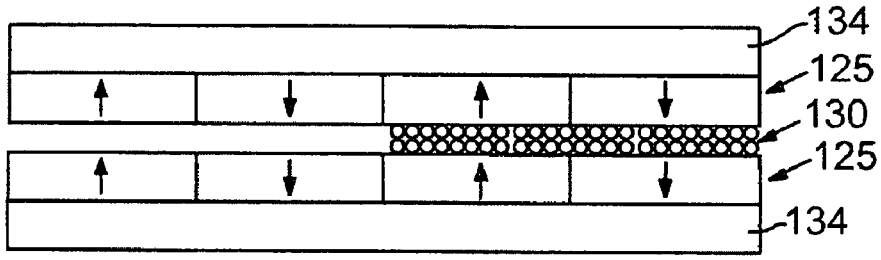

FIGS. 15*a-c* illustrate a surface mount coil 130 arranged between a split second moving element comprising magnets 125. Each magnet 125 includes an iron backing 134. The coil 130 does not require a laminated backer.

Figure 16A:
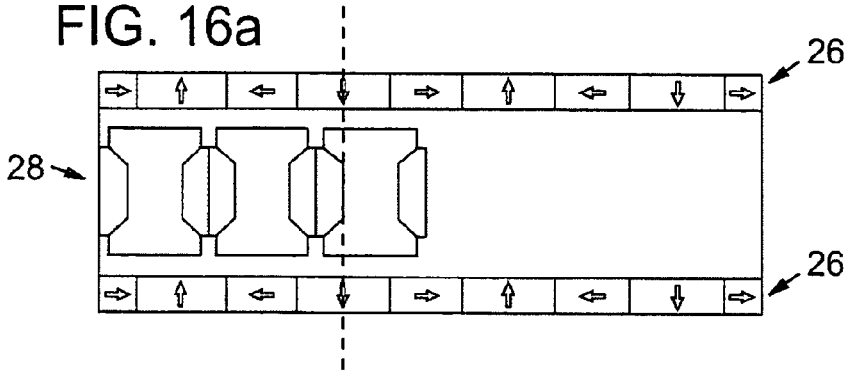
FIGS. 16*a-c* show elements of a magnetic flux generating mechanism in accordance with the present invention.
Figure 16B:
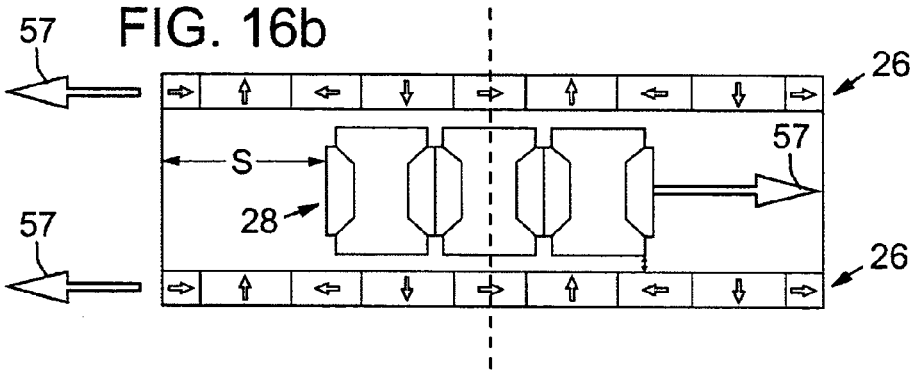
Figure 16C:
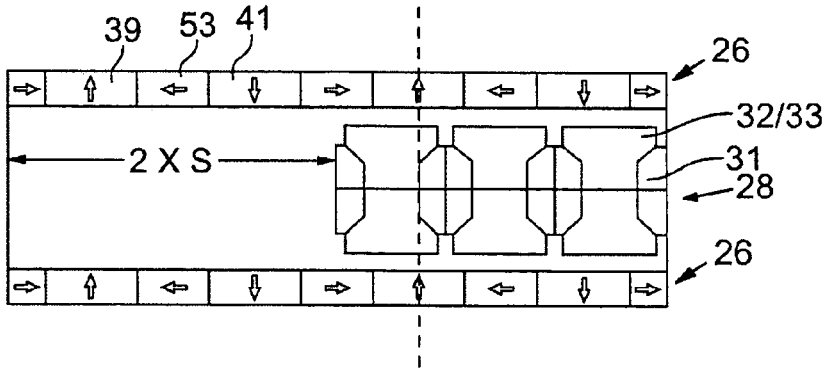

Another embodiment of a split moving element is illustrated in FIGS. 16*a-c*. The first moving element may be coil 28. The second moving element may be a split moving element, such as a Halbach series of magnets 26. The coil 28 moves opposite the spit second moving element.

Figure 17A:
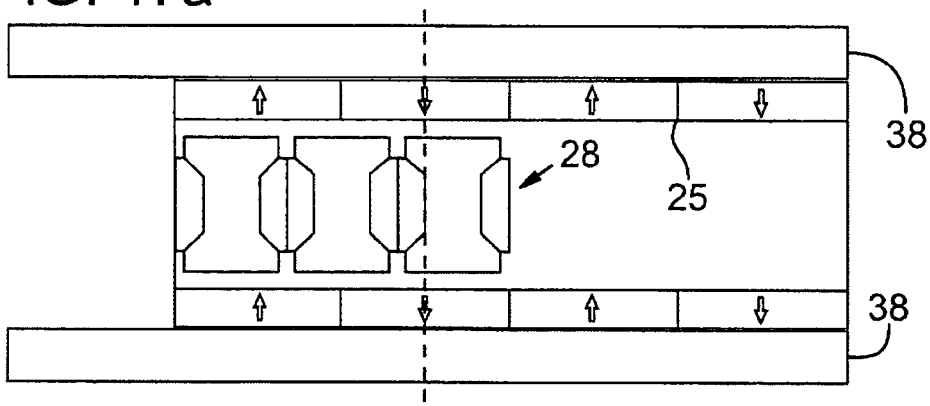
FIGS. 17*a-c* show elements of a magnetic flux generating mechanism in accordance with the present invention.
Figure 17B:
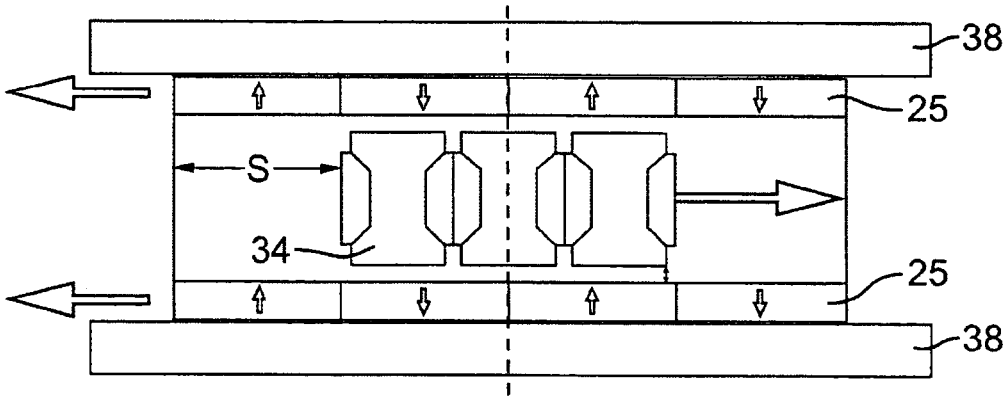
Figure 17C:
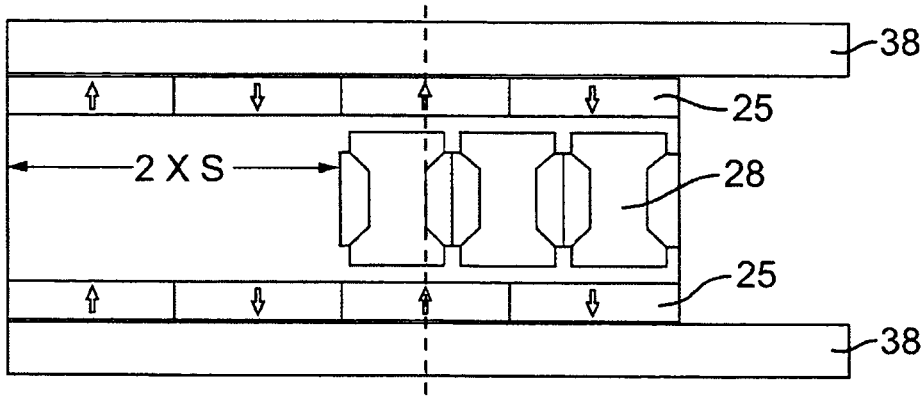

FIGS. 17*a-c* illustrate another suitable arrangement of a first moving element, such as coil 28 and split second moving element, magnets 25. In this example, each magnet 25 is a moving element and has a stationary iron backer 38, respectively, associated with it. In this configuration, the flux change is double the velocity of the moving elements. An OPOC engine may be used to motivate the two moving elements in tandem and opposite direction, as appropriate.

Figure 18A:
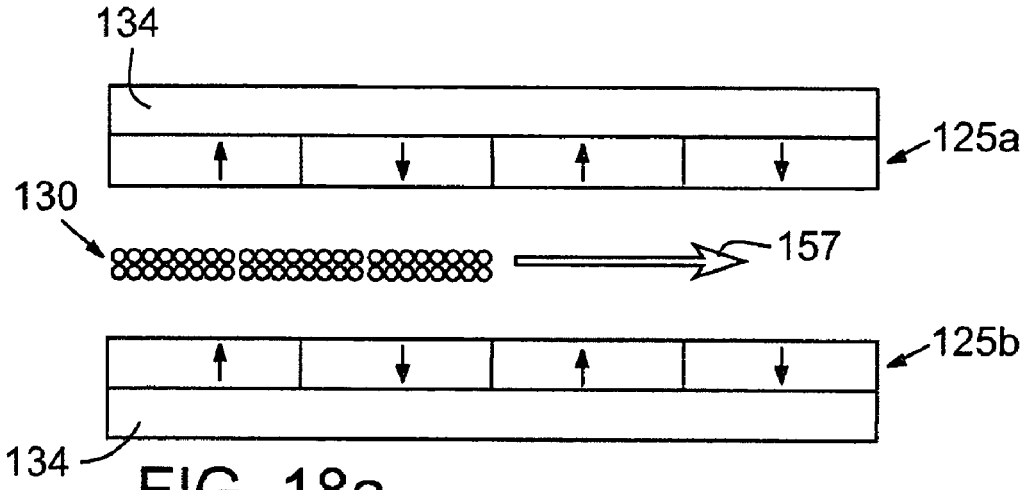
FIGS. 18*a-f* show elements of a magnetic flux generating mechanism in accordance with the present invention.
Figure 18B:
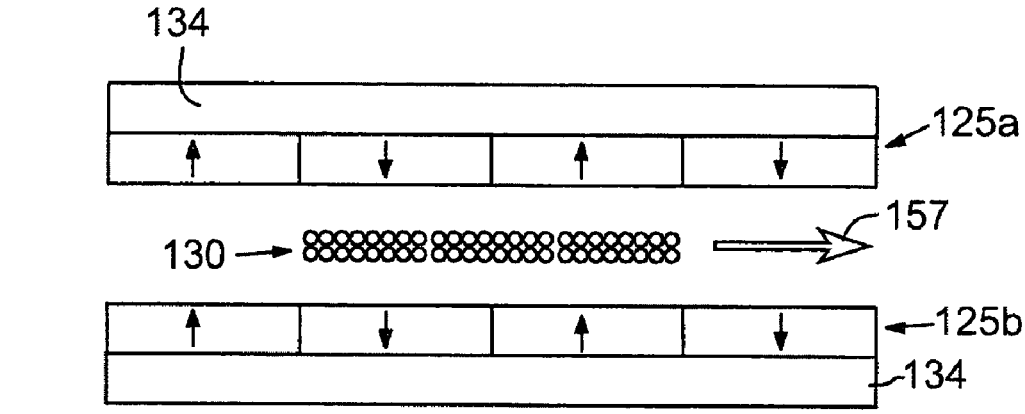
Figure 18C:
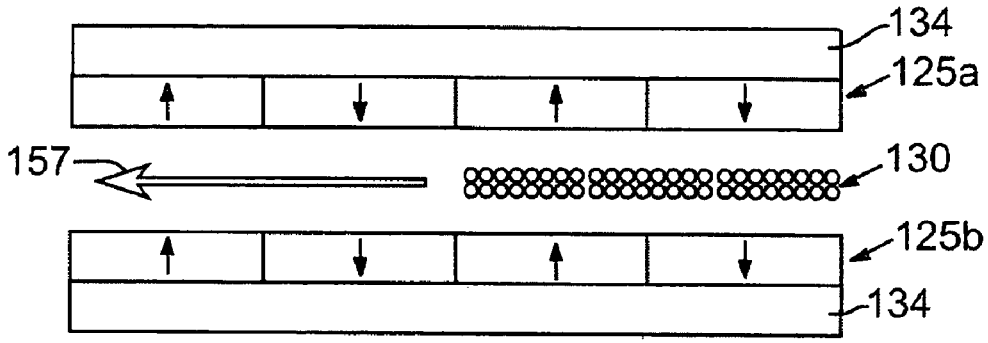
Figure 18D:
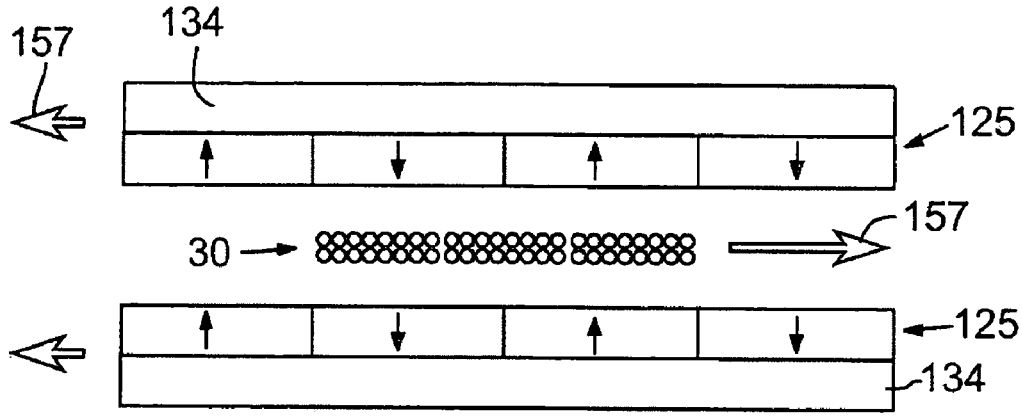
Figure 18E:
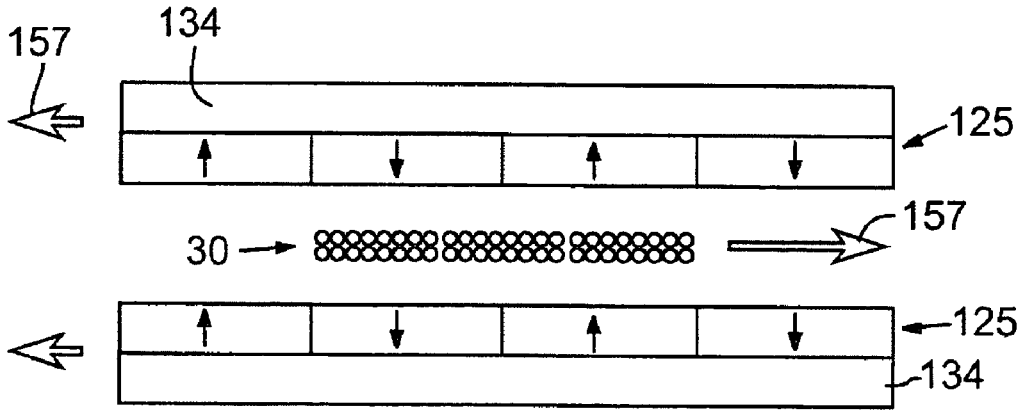
Figure 18F:
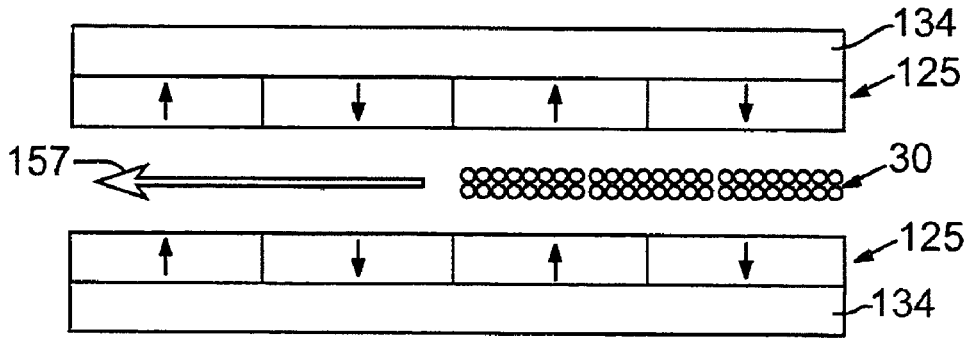

An alternative to two moving elements is described in FIGS. 18*a-c*. Accordingly, the only moving element is coil 130. The magnet 125*a* and 125*b* may be stationary. In this configuration, the flux change would be directly proportional to the speed of the first moving element. Accordingly, when used in combination with an OPOC engine 21 of FIGS. 3-5, the coil 130 would move at the same velocity as one piston, for example the central piston 9. The reciprocating motion of piston 9 is communicated to the coil 130 by a transfer mechanism, such as linking element 83, shown in FIG. 3. To decrease the weight and increase the speed of the moving coil, the coil may be split and one part could be linked to the central piston and one part linked to the outer piston. This will also balance the system without any additional masses.

Figure 19A:
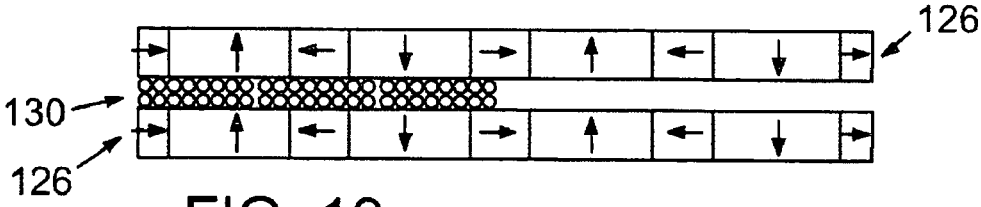
FIGS. 19*a-c* show elements of a magnetic flux generating mechanism in accordance with the present invention.
Figure 19B:
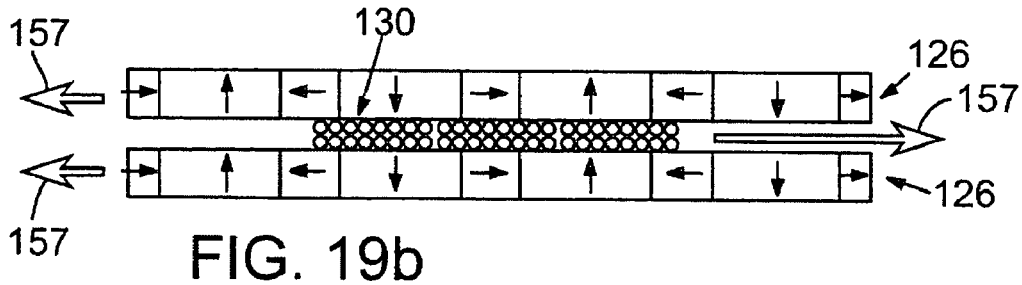
Figure 19C:
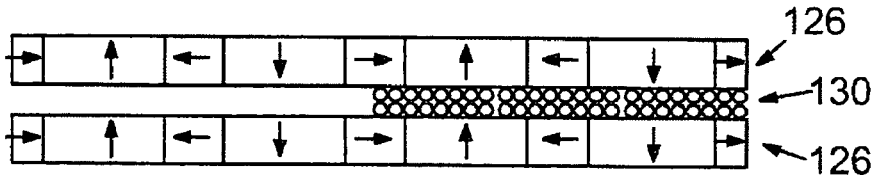

FIG. 19 illustrates a first moving element consisting of a coil 130. The second moving element is split to Halbach series 126. The operation of this example follows the same principles and relates to similarly numerated elements, previously discussed.

Figure 20A:
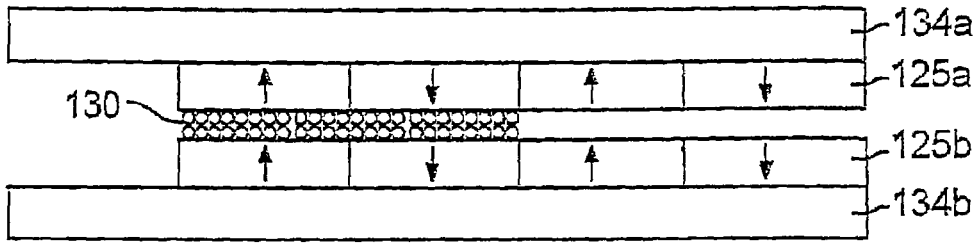
FIGS. 20*a-c* show elements of a magnetic flux generating mechanism in accordance with the present invention.
Figure 20B:
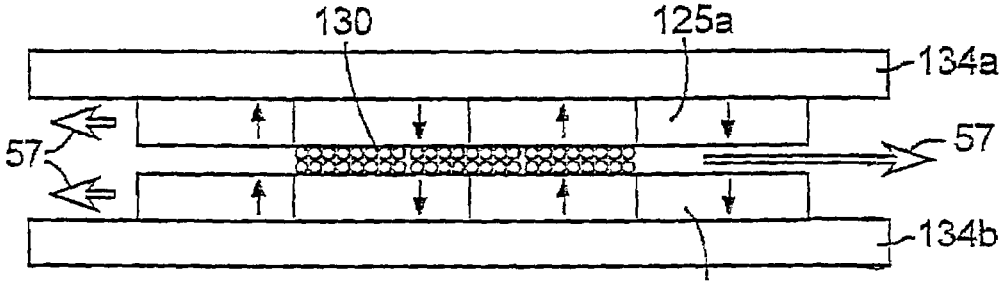
Figure 20C:
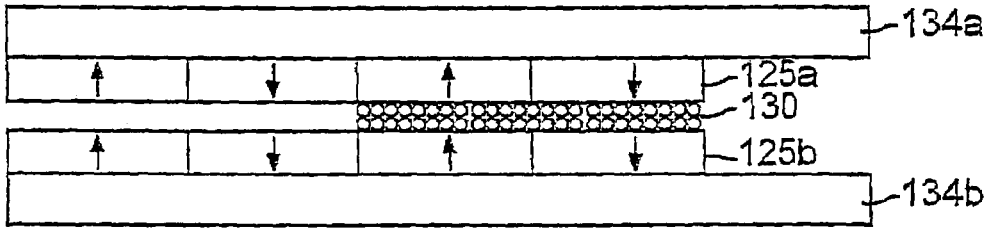

A surface mount coil, such as coil 130 of FIG. 20 may be arranged between a split second moving element, such as magnets 125*a* and 125*b*. As shown in FIG. 20, the magnets 125*a* and 125*b* have an associated stationary iron backer 134*a* and 134*b*, respectively.

In each of the FIGS. 7-8, 10-13, 15-17, 19-20, two opposing lines of movement are required to cause each moving element to reciprocate in opposite directions. This may be provided by any means known or developed.

EXAMPLE OF EPC USING AN OPOC ENGINE

One suitable mechanism that generates two opposing lines of movements is an OPOC engine. A particularly advantageous engine for providing opposing lines of motion is an OPOC free piston engine, such as engine 21 of FIGS. 3-5, or engine 121 of FIGS. 1-2, or the four piston OPOC engine of U.S. Pat. No. 6,170,443. For illustrative purposes, OPOC engine 21 of FIGS. 3-5 will be used to discuss one version of an electric power cell.

As previously presented herein, the OPOC engine 21 has two opposed outer pistons 5 and 7 and central piston 9. Outer pistons 5 and 7 may each have an associated connecting member 82*a* and 82*b*, respectively. The connecting members 82*a* and 82*b* may be linked to each other by one or more linking elements 83. As the outer pistons 5 and 7 linearly reciprocate along axis 45, the motion is transferred outside the engine 21 by the connecting members 82. Thus, the reciprocation of the pistons 5 and 7 is transferred to an axis parallel to axis 45. As shown, the coils 30 are connected or otherwise linked to a linking element 83, which is connected or otherwise linked to the connecting members 82. The coils 30 move in a first line of movement with the tandemly moving outer pistons 5 and 7.

A second line of movement in a direction opposite the motion of the coil 30 is established by connecting or otherwise linking a set of magnets 25 to one or more connecting members, such as connecting member 82*c* connected or otherwise linked to the central piston 9. Since the central piston 9 moves opposite the outer pistons 5 and 7, the magnet 25 moves opposite the coil 30.

To attain a desired balanced system, the electric power generating mechanism may incorporate balanced and oppositely moving elements that have a mass equal to or nearly equal to the second moving element, such as a magnet 25. In addition, to reduce moving mass, the required iron backer may be included in the stationary supporting structure or housing 38.

In contrast to prior art systems of a single moving element with a stationary element, the present invention's use of two oppositely moving elements, such as a magnet and a coil, provides double the speed of flux change as the prior art. The rapid change in flux brought about by two oppositely moving flux generating elements is advantageous because the resulting electric voltage is also doubled.

Figure 5B:
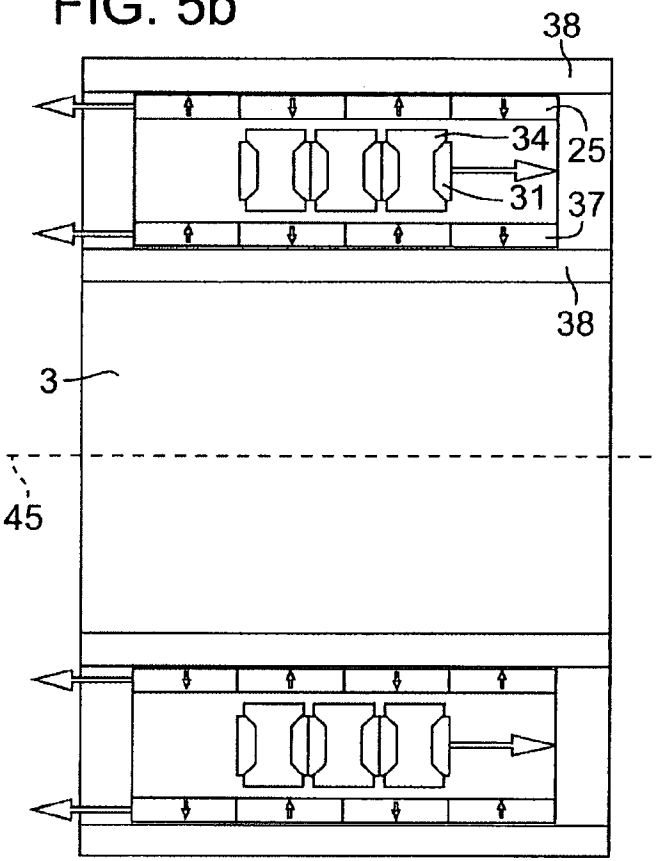
FIGS. 5*a-b* show an end-view and cross section of the embodiment of FIG. 4*a-c*.
Figure 5A:
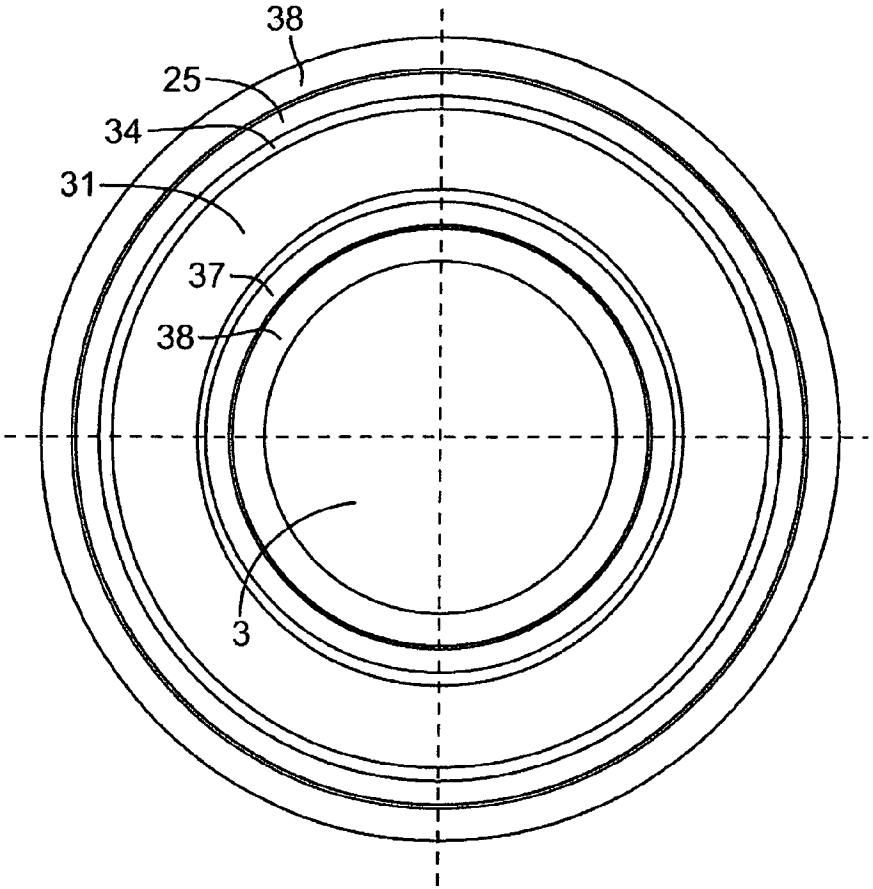

To increase the power density of the systems herein described, the reciprocating speed of the two opposed lines of movement, or the magnetic force, or both, may be increased. Magnetic tension in the air gap is a function of the relationship between the coils, the air gap and the magnetic force. Therefore, by increasing the strength of the magnets, or increasing the number of windings of the coil, optimal configurations can be understood and adjusted to attain a desired power output. Alternately, light moving elements, such as the coil or the magnets, can be reciprocated at a very high rate, which would also increase the power output. Referring to FIGS. 3-5, the relative velocity of the coil 30 to the magnet 25 would be twice the velocity of the linking element 83 or the pistons. The relative speed may be up to 24 m/sec, which is double the feasible mean piston speed of a combustion engine. Accordingly, the rate of flux change is double that of a single line of movement.

This rate of flux change induces an alternating current. FIGS. 3-5, show a 3-phase electrical power generating mechanism. At least one phase may be connected or otherwise linked to the linking element 83*a*, which may be in electrical contact with the one winding of the coil 30. As second winding on coil 30 generates the second phase and may be connected or otherwise linked to the linking element 83*b*, and a third winding on the coil 30 generates the third phase and may be connected or otherwise linked to the linking element 83.

The coil 30 may be wound with aluminum or copper wire. A moving coil, such as coil 30, may use aluminum wire. While aluminum wire has a higher electric resistance, it also has a lower density. Thus, using a larger diameter wire in aluminum may provide desired weight characteristics (½ of the weight with copper) in a moving element.

EXAMPLE OF EPC WITH CIRCUMFERENTIALLY ARRANGED MOVING ELEMENTS

Having generally described the use of an OPOC engine with flux generating elements, certain advantageous features shown in FIGS. 3-5 are now discussed. In the embodiment shown, a magnetic flux generating mechanism is circumferentially disposed along and about the common axis 45 of motion of pistons 5, 7, and 9. For example, a set of magnets 25 and a set of magnets 37 may be disposed concentrically and slidably about an arrangement of coils 30. The coils are associated with a first line of movement provided by a connecting member associated with a central piston 9. A magnet 25 may be connected or otherwise linked to connecting member 82*c*, which would transfer a second line of reciprocal movement from the associated engine. The first and second lines of movement are opposite. Thus, magnet 25 moves relative to coil 30 in an opposite direction. Preferably, there are gaps between each moving element. In this embodiment, a support structure or housing 38 is shown surrounding each primary moving element of the flux generating mechanism. The housing 38 may be used as an iron backer to magnet 25 while simultaneously serving as the support structure for each moving element. The housing 38 is circumferentially arranged around the common axis 45. The housing creates the necessary chambers so that the reciprocating motion of magnet 25 can compress and transfer a volume of air or air and fuel. Such an operation may be useful to provide cooling for components or scavenging for the engine. Air gaps may be left between each concentric cylinder. These gaps may serve as channels for coolant or air or a mixture of air and fuel, which may be used to cool the electric power cell 23. This cooling means may exploit the inherent pumping mechanism of the two moving elements. Optionally, an end magnet may be configured to funnel the coolant into the air gaps. Alternatively, the coolant may be introduced by the linking element 83.

In one embodiment, the coolant may include a super cooled fluid, such as helium. The helium gas may be introduced by a conduit formed inside linking element 83. This super cooled fluid would be maintained in a separate volume, always isolated from the intake gases. This super cooled fluid would lower the temperature of elements of the magnetic flux generating mechanism to provide enhanced conductivity such as superconductivity.

Referring to FIG. 6, the first and second cylinders 3*a* and 3*b* of engine 21, may each have a length of at least 3.5 times the piston stroke PS. This creates an overall length of the power cell 23 of a minimum of 8 times the piston stroke PS.

The overall length is (9±1) times the piston stroke PS. The displacement D of one OPOC unit is: $D=SP\times B^2\times\pi$. The piston stroke PS should be (1±0.15) times the bore B, for example.

The width is (4±1) times the bore B, which includes sufficient space for the movers and stationary supports of the power cell 23.

The "Box volume" BV of one electric power cell is with these above ranges:

$$BV=c\times PS\times B^2;\ \text{where } c=161\pm 89.$$

For example, a power cell 23, as shown in FIGS. 3-5, that includes a first set of movable magnets 25, a second set of movable magnets 37, and a moving coils 31 in FIG. 5 or coils 30, in FIG. 3.

4×B in width 75 and 9×PS in length.

With PS/B=1: The displacement D of one OPOC unit would be:

$$D=PS^3\times\pi$$

The box volume BV of one electric power cell would be: $BV=144\times PS^3$

For example, a 5 kW electric power cell with a piston stroke of 3.2 cm or a displacement D of approximately 100 ccm is necessary.

The box volume is approximately 4.7 Liters.

While this embodiment relates to 3-phase system, it will be understood that other suitable embodiments may include 2-phase, 3-phase, 4-phase, as needed or desired.

EXAMPLE OF EPC WITH RADIALLY ARRANGED MOVING ELEMENTS

Figure 22A:
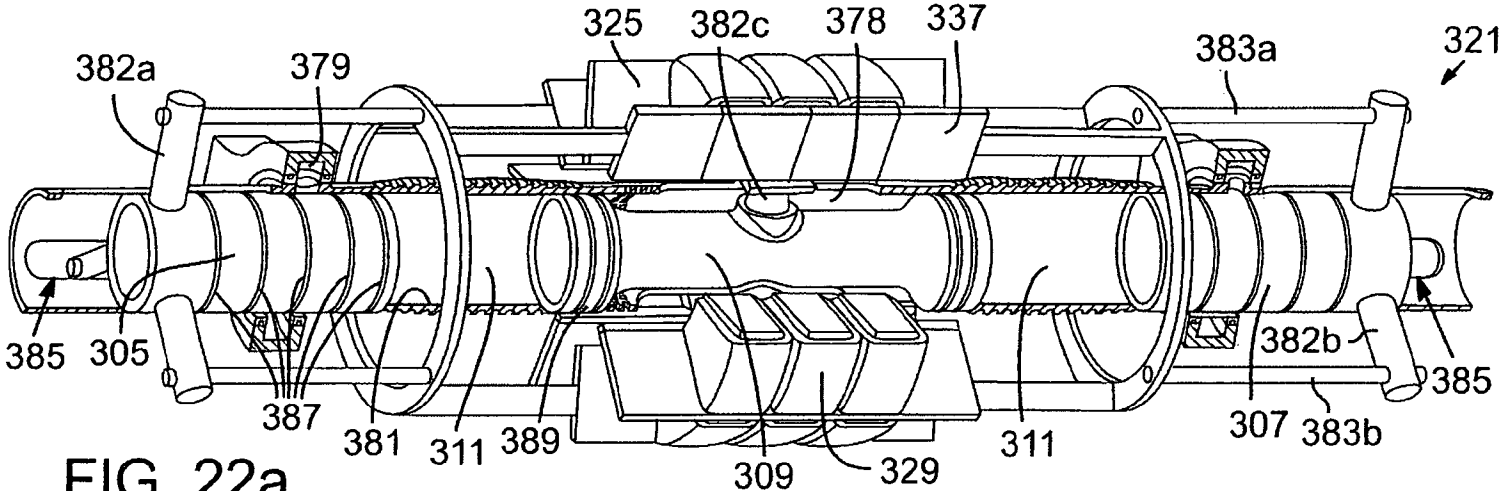
FIGS. 22*a-c* are isometric cross-sections showing operation of an engine and associated mechanical mechanisms according to the present invention.
Figure 22B:
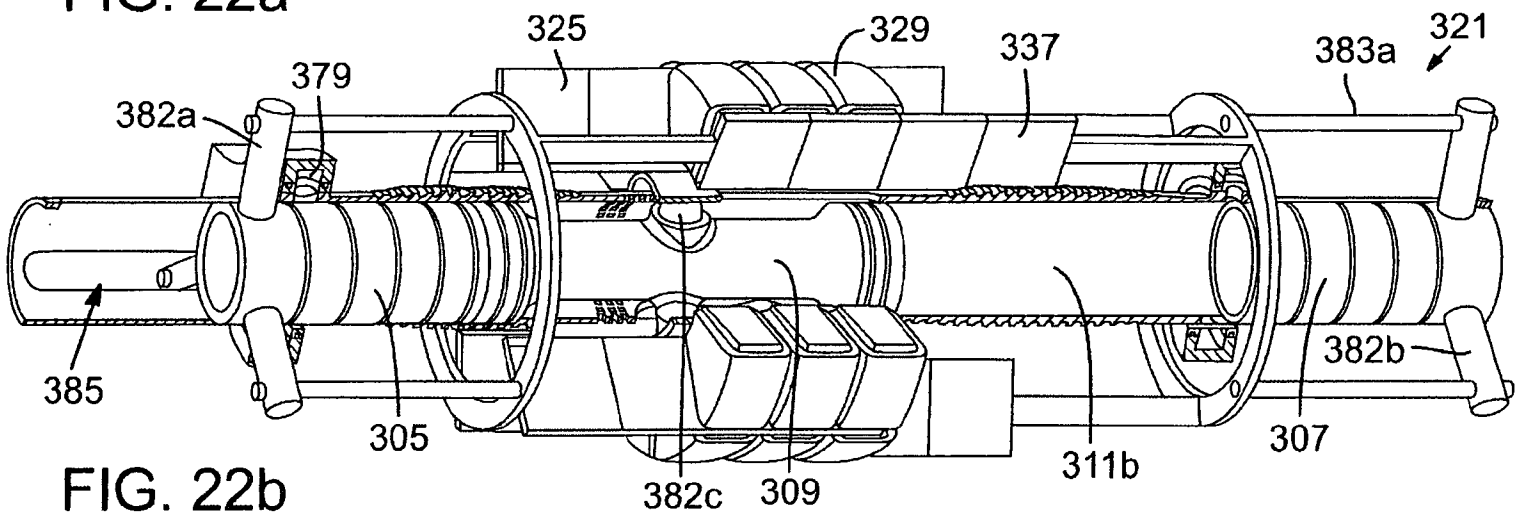
Figure 22C:
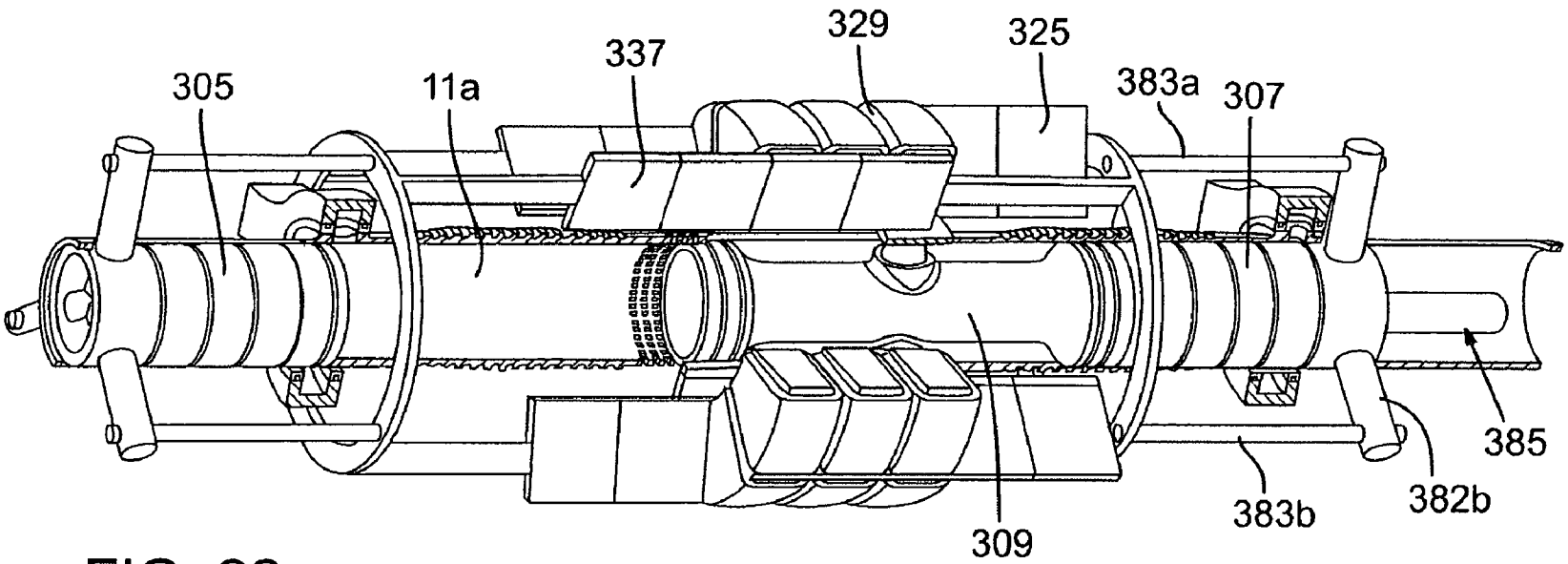

Referring to FIGS. 22*a-c*, an alternative embodiment of the present invention is presented. An OPOC engine 321 having two opposed outer pistons 305 and 307 define two linearly opposed combustion chambers 311*a* and 311*b*, respectively, with central piston 309. Each piston has an associated connecting member 382 whereby linear reciprocation of the piston 305, 307 or 309 is transferred outside the engine 321. The outer pistons 305 and 307 are connected by a linking element 383, which assures that the pistons travel in tandem movement. The linking element 383 may also be used to attach a first moving element, such as magnets 325. Thus, the linear reciprocation of outer pistons 305 and 307 generates tandem motion in magnets 325.

Connected or otherwise linked to the central piston 309 may be a second moving element, such as magnet 337. Central piston 309 moves in an opposite direction to the outer pistons 305 and 307. Thus, two opposed lines of movement are generated external to the engine 321. Further, the two magnets 325 and 337 along with any associated moving elements thereto, may be balanced so that the system operates without any vibration due to dynamic imbalance.

In this embodiment the coil elements are stationary coils 329. However, each magnet 325 and 337 does not include a moving back iron. Thus, the moving elements can be made very light, which will result in higher piston velocities and a more efficient system.

Alternatively, this configuration may be adapted so that one moving element may be a coil and an oppositely moving second element may be a magnet. Similarly, other combinations of moving flux-generating elements may be combined according to the principles of this invention.

This embodiment includes the necessary intake; combustion and exhaust systems as previously discussed in other embodiments of this invention and can be further appreciated by studying the included drawings.

EXAMPLE OF EPC WITH SWITCH RELUCTANCE

Figure 21:
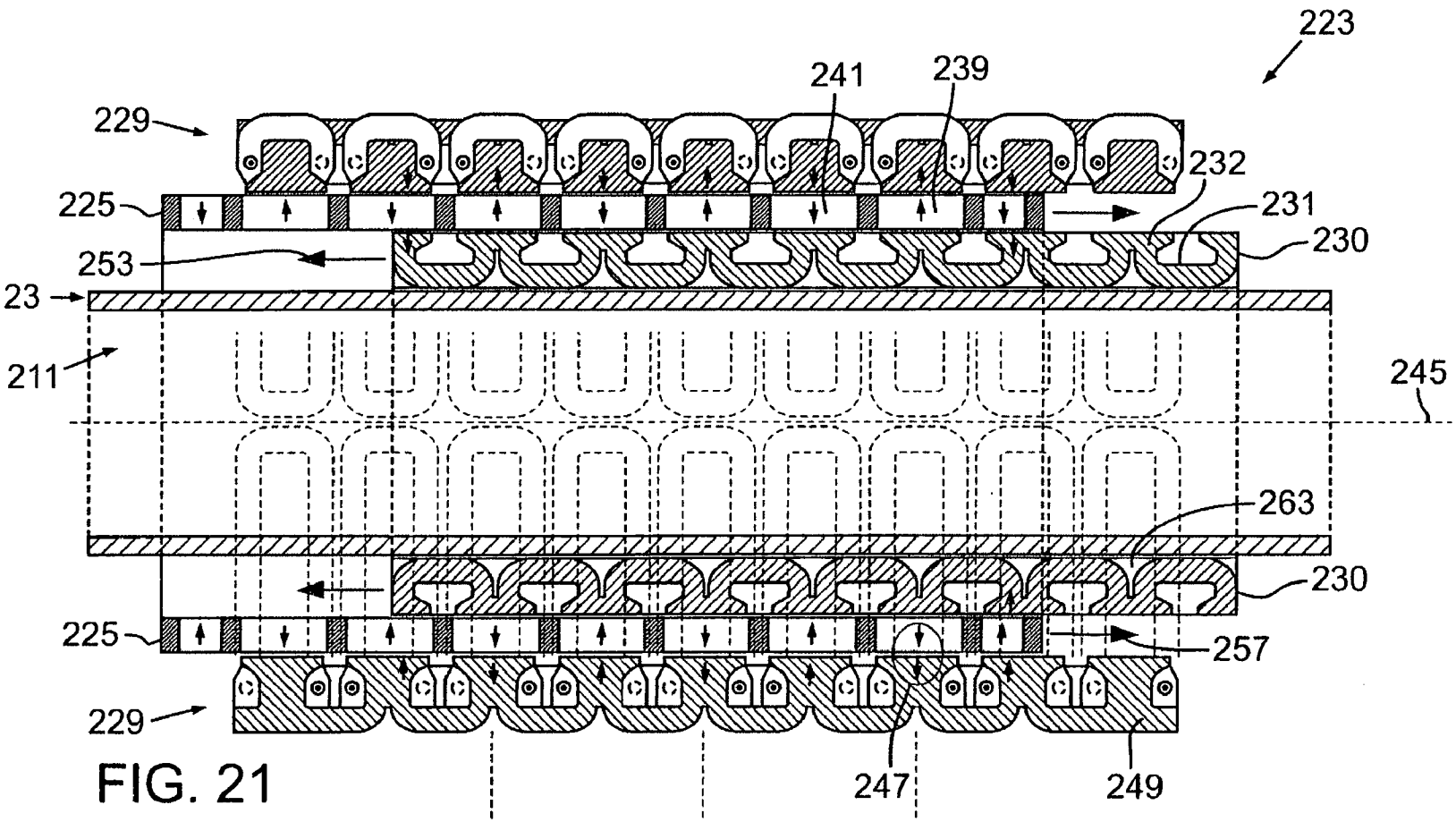
FIG. 21 shows a partial cross section of an electric power generating mechanism and associate engine cylinder according to the present invention.

Referring now to FIG. 21, another embodiment of the invention is described. The system 223 includes a stationary coil 229 arranged around a common axis 245 with the engine (not shown). A first moving element, such as magnet 225 is placed next to the stationary coil 229. A second moving element, such as coil 230 is arranged around the central axis 245 so that the moving magnet 225 is placed intermediate to the stationary coils 229 and the moving coil 230.

Figure 23B:
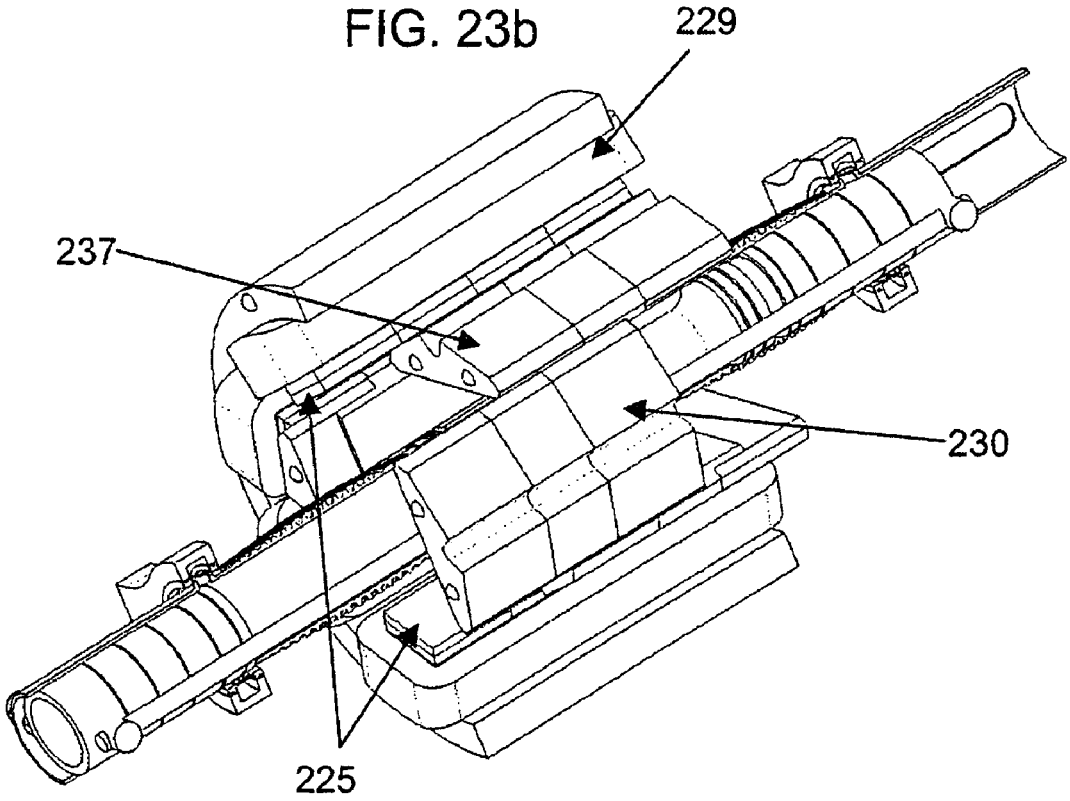

In FIGS. 23*a-c*, another embodiment is shown with a stationary coil 229 included in the support structure and stationary magnets 225. In this embodiment the first moving element is a lamination 230, which could be connected to the outer pistons of the OPOC engine. The second moving element is a lamination 237, which may be connected or otherwise linked to the central piston of the OPOC engine.

EXAMPLE OF EPC AND OPOC ENGINES IN PARALLEL

An electric power generating system, such as a three-phase electric power cell is contemplated. It will be understood that such a design, while producing a pulsating stream of AC electricity may have undesirable electric outputs. Near the dead centers TDC/BDC no current is created. To smooth the electric output, two OPOC engines each with an electric power generating mechanism may be combined. Thereby, two electrical power-generating mechanisms may be arranged in parallel, but operated with a phase of ½ cycle time. Accordingly, the two 3-phase power streams will result in a very uniform and desirable power output.

A capacitor may be included to store the fluctuating current to a more acceptable regulated AC, or alternatively to DC. Thus, the power electronics can be optimized for efficiency and power density.

Based on the representative embodiment discussed herein, it may be understood that a plurality of OPOC engines may be combined in various configurations and coupled either mechanically or electrically by linking elements. In this manner, one or more pairs of opposed piston opposed cylinder combinations may be run simultaneously or be selectively engaged or disengaged as required.

In addition to the aforementioned configuration, the use of a four-piston, opposed piston, opposed cylinder engine, as described in U.S. Pat. No. 6,170,443, is contemplated as a suitable mechanism to be combined with the various electrical power generating and pumping mechanisms described herein.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

The invention claimed is:

1. A pump, comprising:

a pump mechanism; and an internal combustion engine comprising:

at least one set of two outer pistons and a central piston disposed between the outer pistons, the pistons reciprocating on a common axis, at least one piston being a free piston;

an end of a first outer piston and a first end of the central piston, in conjunction with a cylinder for the first outer piston and the central piston, defining a first combustion chamber; and an end of a second outer piston and a second end of the central piston, in conjunction with a cylinder for the second outer piston and the central piston, defining a second combustion chamber, wherein at least one piston includes at least one connecting member communicating with the pump mechanism so as to drive the pump mechanism in correspondence with the piston, and wherein the element external to the cylinder is an element of a pumping mechanism;

wherein the element of the pumping mechanism comprises a movable chamber.

2. The pumping mechanism of claim 1 wherein the mechanism is arranged circumferentially about the engine.

3. The pumping mechanism of claim 1 wherein the engine provides two elements of a pumping mechanism, each linked to opposed lines of movement, one element comprising a plunger and the other a movable chamber, the plunger being disposed in the chamber, and the assembly of the plunger and chamber being disposed in a housing.

4. The pumping mechanism of claim 1 further comprising means for introducing fluid from the pumping mechanism to the engine.

5. The pumping mechanism of claim 4 wherein the means for introducing fluid are adapted to introduce intake gases into an intake port for the engine.

6. The engine of claim 1 wherein the three pistons comprise free pistons.

7. The engine of claim 1 wherein the three pistons comprise free pistons and the outer pistons are linked in tandem movement.

8. A pump, comprising:

a pump mechanism; and an internal combustion engine comprising:

at least one set of two outer pistons and a central piston disposed between the outer pistons, the pistons reciprocating on a common axis, at least one piston being a free piston;

an end of a first outer piston and a first end of the central piston, in conjunction with a cylinder for the first outer piston and the central piston, defining a first combustion chamber; and an end of a second outer piston and a second end of the central piston, in conjunction with a cylinder for the second outer piston and the central piston, defining a second combustion chamber, wherein at least one piston includes at least one connecting member communicating with the pump mechanism so as to drive the pump mechanism in correspondence with the piston, and wherein the element external to the cylinder is an element of a pumping mechanism;

wherein the engine provides two elements of a pumping mechanism, each linked to opposed lines of movement, one element comprising a plunger and the other a movable chamber, the plunger being disposed in the chamber.

9. A pump, comprising:

a pump mechanism; and an internal combustion engine comprising:

at least one set of two outer pistons and a central piston disposed between the outer pistons, the pistons reciprocating on a common axis, at least one piston being a free piston;

an end of a first outer piston and a first end of the central piston, in conjunction with a cylinder for the first outer piston and the central piston, defining a first combustion chamber; and an end of a second outer piston and a second end of the central piston, in conjunction with a cylinder for the second outer piston and the central piston, defining a second combustion chamber, wherein at least one piston includes at least one connecting member communicating with the pump mechanism so as to drive the pump mechanism in correspondence with the piston, and wherein the element external to the cylinder is an element of a pumping mechanism;

further comprising means for introducing fluid from the pumping mechanism to the engine; and wherein the means for introducing fluid is adapted to direct liquid coolant around at least a portion of the cylinder to cool the cylinder.

10. A system for pumping a fluid, comprising:

a housing having concentrically and movably arranged outer and inner chambers, each chamber having intake means, the engine providing at least two externally disposed connecting members providing opposed lined of reciprocating movement, the connecting members linked to each chamber so that the chambers move opposite relative to each other, the engine having an intake port in communication with the outer chamber so that intake gases are drawn into the housing through the intake means and directed into the engine.

11. The pumping system of claim 10 wherein at least one linking element is linked to a connecting member, the linking element having a channel wherein a coolant fluid or gas may be introduced to at least one chamber.

* * * * *

UNITED STATES PATENT AND TRADEMARK OFFICE

CERTIFICATE OF CORRECTION

PATENT NO. : 7,255,070 B2
APPLICATION NO. : 11/437115
DATED : August 14, 2007
INVENTOR(S) : Peter Hofbauer It is certified that error appears in the above-identified patent and that said Letters Patent is hereby corrected as shown below:

Column 20, Claim 10, line 39, “the” should be -- an --.

Signed and Sealed this

Fourth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,255,070 B2
APPLICATION NO. : 11/437115
DATED : August 14, 2007
INVENTOR(S) : Peter Hofbauer It is certified that error appears in the above-identified patent and that said Letters Patent is hereby corrected as shown below:

Column 18, line 67 “pump” should be --pumping--.
Column 19, lines 15, 16, and 41 “pump” should be --pumping--;
line 17 “the element” should be --an element--.
line 18 “a” should be --the--.
Column 20, lines 3, 4, 12, 27, 28 “pump” should be --pumping--;
lines 5 and 29 “the element” should be --an element--.
lines 6 and 30 “a” should be --the--.

Signed and Sealed this

Twenty-third Day of December, 2008

JON W. DUDAS
*Director of the United States Patent and Trademark Office*